US011232802B2

(12) United States Patent
Bernard et al.

(10) Patent No.: US 11,232,802 B2
(45) Date of Patent: Jan. 25, 2022

(54) METHOD FOR CONVERSION, STEREOPHONIC ENCODING, DECODING AND TRANSCODING OF A THREE-DIMENSIONAL AUDIO SIGNAL

(71) Applicant: Coronal Encoding S.A.S., Lyons (FR)

(72) Inventors: Benjamin Bernard, Monaco (MC); Francois Becker, Massy (FR)

(73) Assignee: Coronal Encoding S.A.S., Lyons (FR)

( * ) Notice: Subject to any disclaimer, the term of this patent is extended or adjusted under 35 U.S.C. 154(b) by 266 days.

(21) Appl. No.: 16/333,433

(22) PCT Filed: Sep. 28, 2017

(86) PCT No.: PCT/EP2017/025274

§ 371 (c)(1),
(2) Date: May 22, 2019

(87) PCT Pub. No.: WO2018/059742

PCT Pub. Date: Apr. 5, 2018

(65) Prior Publication Data

US 2020/0168235 A1 May 28, 2020

(30) Foreign Application Priority Data

Sep. 30, 2016 (MC) ..... 2624

(51) Int. Cl.
*G10L 19/02* (2013.01)
*G10L 19/008* (2013.01)
(Continued)

(52) U.S. Cl.
CPC ..... *G10L 19/02* (2013.01); *G10L 19/008* (2013.01); *H04R 5/033* (2013.01); *H04R 5/04* (2013.01); *H04S 3/00* (2013.01)

(58) Field of Classification Search
CPC ..... H04S 2420/11; H04S 2400/15; H04S 2400/01; H04S 2400/11; H04S 2400/09;
(Continued)

(56) References Cited

U.S. PATENT DOCUMENTS 3,632,886 A 1/1972 Scheiber
4,334,740 A 6/1982 Wray
(Continued)

FOREIGN PATENT DOCUMENTS

EP 2285139 2/2011
EP 2346028 7/2011
(Continued)

OTHER PUBLICATIONS

Trevino, Jorge et al., "Enhancing Stereo Signals with High-Order Ambisonics Spatial Information", IEICe Trans. Inf. & Syst., vol. E99-D, No. 1, Jan. 2016, pp. 41-49 (Year: 2016).*
(Continued)

*Primary Examiner* — Linda Wong
(74) *Attorney, Agent, or Firm* — Womble Bond Dickinson (US) LLP

(57) ABSTRACT

Methods for converting, encoding, decoding and transcoding an acoustic field, more particularly a first-order Ambisonics three-dimensional acoustic field.

4 Claims, 13 Drawing Sheets

(51) Int. Cl.
*H04R 5/033* (2006.01)
*H04S 3/00* (2006.01)
*H04R 5/04* (2006.01)

(58) Field of Classification Search
CPC . H04S 7/301; H04S 3/008; H04S 7/30; G06F 2203/0381; G06F 3/04815; G06F 3/165; G06F 3/167; G10L 19/008; G10L 15/22; G10L 19/167
See application file for complete search history.

(56) References Cited

U.S. PATENT DOCUMENTS

| | | | | |
|---|---|---|---|---|
| 4,696,036 | A | 9/1987 | Julstrom | |
| 4,862,502 | A | 8/1989 | Griesinger | |
| 5,136,650 | A | 8/1992 | Griesinger | |
| 5,664,021 | A | 9/1997 | Chu et al. | |
| 6,041,127 | A | 3/2000 | Elko | |
| 6,430,293 | B1 | 8/2002 | Finsterle | |
| 6,507,659 | B1 | 1/2003 | Iredale et al. | |
| 8,170,260 | B2 | 5/2012 | Reining et al. | |
| 8,712,061 | B2 | 4/2014 | Jot et al. | |
| 9,838,819 | B2 * | 12/2017 | Peters | H04S 5/00 |
| 2002/0009203 | A1 | 1/2002 | Erten | |
| 2002/0037086 | A1 | 3/2002 | Irwan et al. | |
| 2003/0142836 | A1 | 7/2003 | Warren et al. | |
| 2004/0013038 | A1 | 1/2004 | Kajala et al. | |
| 2006/0222187 | A1 | 10/2006 | Jarrett et al. | |
| 2007/0237340 | A1 | 10/2007 | Pfanzagl-Caronde | |
| 2008/0063224 | A1 | 3/2008 | De Klerk | |
| 2008/0199023 | A1 | 8/2008 | Kantola | |
| 2008/0200567 | A1 | 8/2008 | Schilling et al. | |
| 2008/0205676 | A1 | 8/2008 | Merimaa et al. | |
| 2008/0219485 | A1 | 9/2008 | Kantola | |
| 2009/0175466 | A1 | 7/2009 | Elko et al. | |
| 2010/0142732 | A1 | 6/2010 | Craven et al. | |
| 2010/0329466 | A1 | 12/2010 | Berge | |
| 2011/0249822 | A1 | 10/2011 | Jaillet et al. | |
| 2012/0288114 | A1 | 11/2012 | Duraiswami et al. | |
| 2013/0016842 | A1 | 1/2013 | Schultz-Amling et al. | |
| 2014/0219471 | A1 | 8/2014 | Deshpande et al. | |
| 2014/0249827 | A1 * | 9/2014 | Sen | G10L 19/008 704/500 |
| 2015/0281833 | A1 | 10/2015 | Shigenaga et al. | |
| 2016/0088392 | A1 | 3/2016 | Huttunen et al. | |
| 2017/0034616 | A1 | 2/2017 | Yoshino | |
| 2017/0243589 | A1 * | 8/2017 | Krueger | G10L 19/008 |
| 2019/0373362 | A1 | 12/2019 | Ansai et al. | |

FOREIGN PATENT DOCUMENTS

| | | |
|---|---|---|
| FR | 2908586 | 5/2008 |
| WO | 0207481 | 1/2002 |
| WO | 2009046223 | 4/2009 |
| WO | 2009046460 | 4/2009 |
| WO | 2010076460 | 7/2010 |
| WO | 2014076430 | 5/2014 |

OTHER PUBLICATIONS

Trevion, Jorge et al, "A Spatial Extrapolation Method to Derive High-Order Ambisonics Data from Stereo Sources" Journal of Information Hiding and Multimedia Signal Processing, vol. 6, No. 6, Nov. 2015, pp. 1100-1116 (Year: 2015).*
International Preliminary Report on Patentability for International Application No. PCT/EP2017/025255 dated Mar. 30, 2019, 19 pages.
Article 94(3) EPC for European Application No. 17787331.2 mailed Jan. 27, 2020, 13 pages.
Office Action for U.S. Appl. No. 16/286,854 dated Apr. 16, 2020, 12 pages.
PCT-Intemational Preliminary Report on Patentability and Written Opinion dated Apr. 11, 2019 for related PCT Application No. PCT/EP2017/025274; 14 Pages.
International Search Report and Written Opinion for Application No. PCT/EP2017/025274 dated Mar. 9, 2018.
Communication Concerning Correction of Deficiencies in Written Opinion/Amendment of Application for European Application No. 17787331.2 dated Feb. 12, 2019.
Balan, R., et al., "Statistical Properties of STFT Ratios for Two Channel Systems and Applications to CLIND Source Separation," Proc. ICA-BSS, 2000.
Gerzon, Michael, "Whither Four Channels?", Audio Annual 1971, 12 pages.
Gerzon, Michael A., "A Geometric Model for Two-Channel Four-Speaker Matrix Stereo Systems," Journal of the Audio Engineering Society, vol. 23, No. 2, Mar. 1975, pp. 98-106.
Maher, Robert C., "Evaluation of a Method for Separating Digitized Duet Signals," J. Audio Eng. Soc., vol. 38, No. 12, Dec. 1990, pp. 956-979.
Scheiber, Peter, "Analyzing Phase-Amplitude Matrices," Journal of the Audio Enginerring Society, vol. 19, No. 10, Nov. 1971, pp. 835-839.
Sommerwerck, William, et al. "The Threat of Dolby Surround," MultiChannelSound, vol. 1, Nos. 4 & 5, Oct.-Nov. 1986, 5 pages.
Trevino, Jorge, et al., "A Spatial Extrapolation Method to Derive High-Order Ambisonics Data from Stereo Sources," Journal of Information Hiding and Multimedia Signal Processing, vol. 6, No. 6, Nov. 2015, pp. 1100-1116.
Trevino, Jorge, et al., "Enhancing Stereo Signals with High-Order Ambisonics Spatial Information," Ieice Trans. Inf. & Syst., vol. E99-D, No. 1, Jan. 2016, pp. 41-49.
Papoulis, Athanasios, "Signal Analysis," McGraw Hill, 1977, pp. 174-178.
Merimaa, Juha, "Analysis, synthesis, and perception of spatial sound: Binaural localization modeling and multichannel loudspeaker reproduction", Helsinki University of Technology, Doctoral Dissertation, Aug. 11, 2006, 196 pages.
Vennerod, Jakob, "Binaural Reproduction of Higher Order Ambisonics", Electronics System Design and innovation, Jun. 2014, 113 pages.
Julstrom, Stephen, "A High-Performance Surround Sound Process for Home Video", Journal of AES, vol. 35, No. 7/8, Jul./Aug. 1987, pp. 536-549.
Pulkki, Ville, "Spatial Sound Reproduction with Directional Audio Coding", J. Audio Eng. Soc., vol. 55, No. 6, Jun. 2007, pp. 503-516.
Pulkki, Ville, "Directional audio coding in spatial sound reproduction and stereo upmixing", AES 28th International Conference: The Future of Audio Technology—Surround and Beyond, Jun. 2006, pp. 1-8.
International Search Report and Written Opinion for Application No. PCT/EP2017/025255 dated Nov. 24, 2017.
Cheng, Bin, et al., "A General Compression Approach to Multi-Channel Three-Dimensional Audio", IEEE Transactions on Audio, Speech, Language Processing, vol. 21, No. 8, Aug. 2013, pp. 1676-1688.
Dong, Shi, et al., "Expanded three-channel mid/side coding for three-dimensional multichannel audio systems", EURASIP Journal on Audio, Speech, and Music Processing, 2014, pp. 1-13.
Hurtado-Huyssen, Antoine, et al., "Acoustic intensity in multichannel rendering systems", Audio Engineering Society Convention Paper 6548, Oct. 7, 2005, 8 pages.
Herre, Jurgen, et al., "MPEG-H Audio—The New Standard for Universal Spatial/3D Audio Coding", J. Audio Eng. Soc., vol. 62, No. 12, Dec. 2014, pp. 821-830.

* cited by examiner

METHOD FOR CONVERSION, STEREOPHONIC ENCODING, DECODING AND TRANSCODING OF A THREE-DIMENSIONAL AUDIO SIGNAL

TECHNICAL FIELD

The present invention relates to a method and process for processing an audio signal, and more particularly a process for the conversion and stereophonic encoding of a three-dimensional audio signal, its decoding and transcoding for retrieval thereof.

BACKGROUND AND STATE OF THE ART

The production, transmission and reproduction of a three-dimensional audio signal is an important part of any audio-visual immersion experience, for example in the context of presentations of content in virtual reality, but also when viewing cinematographic content or in the context of recreational applications. Any three-dimensional audio content thus goes through a production or capture phase, a transmission or storage phase and a reproduction phase.

The production or obtainment phase of the content can be done through many very widespread and widely used techniques: stereophonic, multichannel or periphonic capture, or content synthesis from separate elements. The content is then represented either through a number of separate channels, or in the form of a periphonic sound field (for example in order 1 or higher Ambisonics format), or in the form of separate sound objects and spatial information.

The reproduction phase is also known and widespread in professional or general public fields: stereophonic headsets or headsets benefiting from binaural rendering, devices with stereophonic enclosures (optionally benefiting from transaural processing), multichannel devices or devices with a three-dimensional arrangement. The transmission phase can be made up of a simple channel-by-channel transmission, or a transmission of the separate elements and spatial information making it possible to reconstitute the content, or encoding making it possible, most often with losses, to describe the spatial content of the original signal. There are many audio encoding processes making it possible to preserve all or some of the spatial information present in the original three-dimensional signal.

Beginning in the 1960s, Peter Scheiber was one of the first to describe a stereophonic mastering process of a planar surround field and then provided for using what has since born the name "Scheiber sphere" as immediate correspondence tool for the magnitude and phase relationship between two channels and a three-dimensional spatial position.

For example, in "Analyzing Phase-Amplitude Matrices" (JAES, 1971), Scheiber introduced the concept of linear mastering using the phase and amplitude difference to encode and decode spatial positions, in two or three dimensions, defining what is now known as the "inter-channel domain" (i.e., the domain with two dimensions made up of amplitude differences between the two channels on the one hand, and phase differences on the other hand) and reveals an implementation thereof in U.S. Pat. No. 3,632,886. However, due to the linearity of the encoding and decoding operations, the separation performance between channels is then limited for this implementation.

A critical analysis of stereophonic mastering systems of type 4-2-4 (i.e., four original channels, mastered and transported on 2 channels, then decoded and reproduced on 4 channels) is provided by Gerzon in "Whither Four Channels" (Audio Annual, 1971). In "A Geometric Model for Two-Channel Four-Speaker Matrix Stereo System" (JABS, 1975), Gerzon studies and proposes several possibilities for 4-2-4 mastering, and again describes the possibilities for describing a three-dimensional field on the energy sphere (whose principle is identical to the "Scheiber sphere"), and therefore three-dimensional encoding on two channels. This last capacity is recalled by Sommerwerck and Scheiber in "The Threat of Dolby Surround" (MultiChannelSound, Vol. 1, Nos. 4/5, 1986).

In "A High-Performance Surround Sound Process for Home Video" and the corresponding implementation disclosed in U.S. Pat. No. 4,696,036, Julstrom uses the concepts developed by Scheiber and Gerzon to obtain an improved separation of the original signals in the favored directions corresponding to a placement of seven speakers in the horizontal plane. Techniques having a similar aim of improving the separation are presented in later publications, such as U.S. Pat. Nos. 4,862,502, 5,136,650, or WO 2002007481.

In 1996, in U.S. Pat. No. 5,136,650, Scheiber presents a hemispherical encoding system on two channels, which applies this principle in the temporal domain, in a mastered manner similar to the surround mastered techniques, and adding a decorrelation variable as an additional dimension making it possible to describe the distance of the sound source relative to the origin of the hemisphere; this decoder is, inter alia, provided to supply the matrix decoders then commercially available; the decorrelation prevents said decoders from determining a unique position for the source, which leads to spatial spreading during the decoding. The same patent presents decoders adapted to the encoder, allowing a broadcast on transducers arranged along a hemisphere.

It has been known since the 1970s and 1980s that the short-term Fourier transform, described for example in Papoulis, "Signal Analysis" (McGraw Hill, 1977 pp. 174-178), is a useful tool for processing the signal in separate frequency bands. Furthermore, the advantages of this transformation principle in the frequency domain are known in the context of source separation (which requires a spatial analysis of the signal), for example in Maher, "Evaluation of a Method for Separating Digitized Duet Signals" (JABS Volume 38 Issue 12 pp. 956-979; December 1990), then in Balan et al., "Statistical properties of STFT ratios for two channel Systems and applications to blind source separation" (Proc. ICA-BSS, 2000). It is also known that other types of transforms such as the complex wavelet transform (CWT), the modified discrete cosine transform (MDCT, used in MP3 or Vorbis codes), or the modulated complex lapped transform (MCLT) can advantageously be used in the context of processes for processing the digital audio signal. Thus, a direct application of the principle described by Peter Scheiber was made possible in the frequency domain, but as we will describe later, to within the knowledge of the phase.

In U.S. Pat. No. 8,712,061, Jot et al. again describe the correspondence (mapping) techniques between the Scheiber sphere (amplitude-phase) and the coordinates of the physical space, optionally via a surround or periphonic panoramic law that is next mastered traditionally, and while presenting an implementation in the frequency domain, based inter alia on the need to have, as input, a directional signal and a non-directional "ambient" signal. In addition to this last decomposition constraint of the incoming signal, this approach suffers, whether during the encoding or decoding phase, from a major problem of discontinuity of the phase representation: there is a spatial discontinuity of the phase with a temporally static correspondence of the phase introduced by a generic "panoramic law", introducing artifacts when a sound source is placed in certain directions of the sphere or moves over the sphere while performing certain trajectories. As will be apparent in the continuation of the present document, the present invention makes it possible to solve this discontinuity problem and does not require separation of the incoming signal into an ambient part and a direct part.

The matrix decoder described in US 20080205676 by Merimaa et al. copies the methods disclosed in U.S. Pat. No. 5,136,650 in the frequency domain. Like in the preceding patents, the issue of phase discontinuity is not addressed.

In WO 2009046223, Goodwin et al. describe a format conversion and binaural rendering device from a stereophonic signal, which is based on a primary source/ambient source decomposition similar to that disclosed in U.S. Pat. No. 8,712,061, and a direction of origin analysis using the methods disclosed by Scheiber in U.S. Pat. No. 5,136,650. Like in the preceding patents, the issue of phase discontinuity is not addressed.

In "A Spatial Extrapolation Method to Derive High-Order Ambisonics Data from Stereo Sources" (J. Inf. Hiding and Multimedia Sig. Proc, 2015), Trevino et al. propose a two-dimensional (planar) decoding system of an HOA field previously encoded on a stereophonic stream, still according to the principles of Scheiber. The main problems encountered by the authors are on the one hand the presence of a phase discontinuity (for values close to $\pi$) and on the other hand instabilities in the extreme stereo panoramic positions, for which the metrics used are indefinite. In "Enhancing Stereo Signals with High-Order Ambisonics Spatial Information" (IEICE, 2016), an encoding method making it possible to obtain said signal is specified, still with the same issues of phase and amplitude discontinuity. In both cases, the authors try to lessen said discontinuity problems by applying an empirical correction of the level and phase difference metrics, followed by a deformation of the inter-channel domain, at the cost of a compromise between stability and localization precision. The method disclosed in the present document makes it possible to settle these two problems without stability or localization precision compromise.

One of the aims of the present invention is to disclose a method that makes it possible, in the context of encoding toward a stereophonic stream or in the context of decoding of a stereophonic encoded stream, a continuity of the signal including its phase, irrespective of the position of the source and irrespective of the path it describes, without requiring a non-directional component in the input signal, or the matricial encoding of the signal, or compromise between stability and localization precision for the extreme positions in the inter-channel domain.

Another aim of the present invention is to provide decoding and transcoding from a stereophonic signal, optionally encoded with one of the implementations of the invention, or encoded with the existing matricial encoding systems, and to negate it on any broadcasting means and in any audio format, without requiring any compromise between stability and localization precision.

Another aim of the present invention is to provide a complete transport or storage chain for a three-dimensional acoustic field, in a compact format accepted by the standard transport or storage means, while retaining the relevant three-dimensional spatial information of the original field.

DETAILED DESCRIPTION

Figure 1:
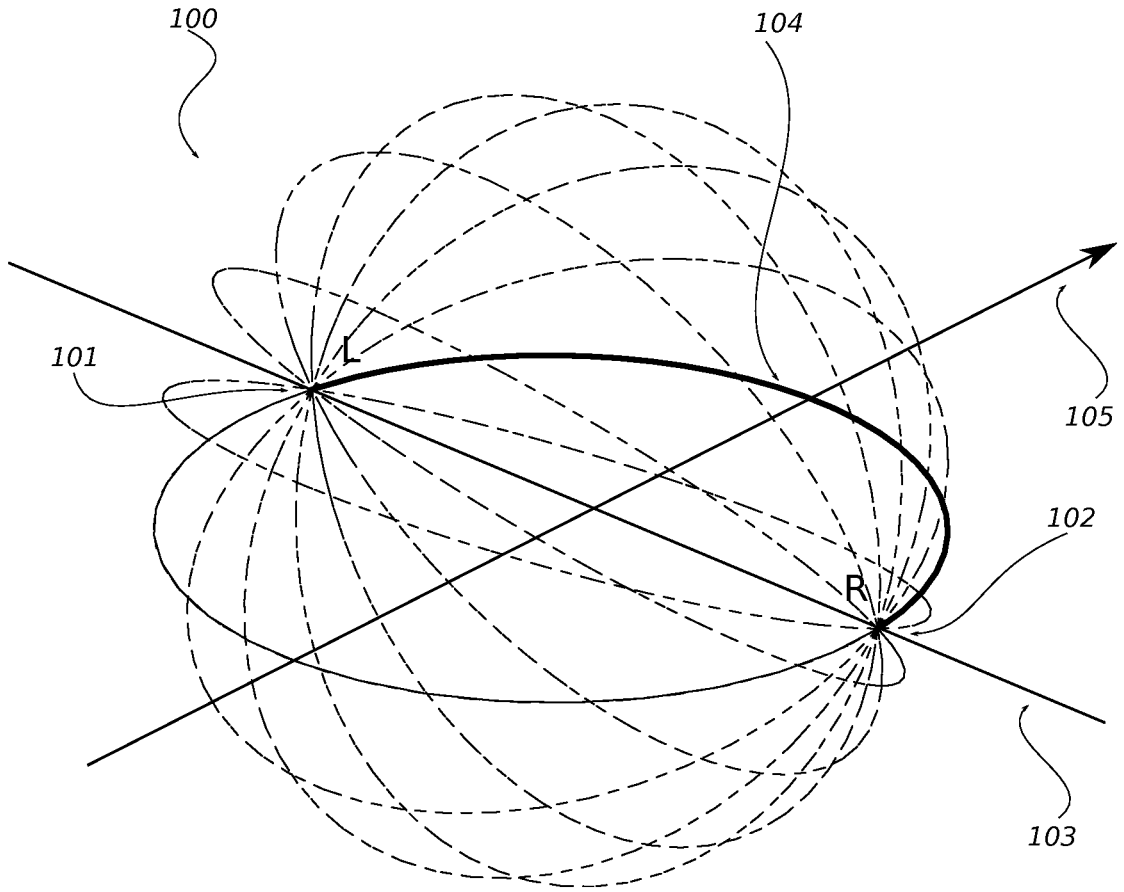
FIG. 1 shows the Scheiber sphere (also called Stokes-Poincare sphere or energy sphere) as defined, for example, in "Analyzing Phase-Amplitude Matrices", Journal of the Audio Engineering Society, Vol. 19, No. 10, p. 835 (November 1971).

The techniques described hereinafter deal with data that assume the form of complex frequency coefficients. These coefficients represent a frequency band over a reduced temporal window. They are obtained using a technique called short-term Fourier transform (STFT), and may also be obtained using similar transforms, such as those from the family of complex wavelet transforms (CWT), complex wavelet packet transforms (CWPT), the modified discrete cosine transform (MDCT) or the modulated complex lapped transform (MCLT), etc. Each of these transforms, applied on successive windows and overlapping the signal, has an inverse transform making it possible, from the complex frequency coefficients representing all of the frequency bands of the signal, to obtain a signal in temporal form.

In the present document, we define:

$$\text{the operator } Norm\langle .|. \rangle \text{ such that } Norm\left\langle \vec{v} \,|\, \vec{d} \right\rangle = \begin{cases} \vec{v}/\|\vec{v}\| \text{ if } \vec{v} \neq \vec{0} \\ \vec{d} \text{ if } \vec{v} = \vec{0} \end{cases}$$

the operator $\mathrm{Re}[\vec{v}]$ which designates the real part of the vector $\vec{v}$, i.e., the vector of the real parts of the components of the vector $\vec{v}$;

the operator $\vec{v}^*$ which is the conjugation operator of the complex components of the vector $\vec{v}$;

the operator a tan 2(y,x) which is the operator that gives the oriented angle between a vector $(1,0)^T$ and a vector $(x,y)^T$; this operator is available in the form of a function std::a tan 2 from the STL library of the C++ language.

Using one of the time-to-frequency transforms previously described, two channels in temporal form, for example, forming a stereophonic signal, can be transformed to the frequency domain in two complex coefficient tables. The complex frequency coefficients of the two channels can be paired, so as to have one pair for each frequency or frequency band from a plurality of frequencies, and for each temporal window of the signal.

Each pair of complex frequency coefficients can be analyzed using two metrics, combining information from two stereophonic channels, which are introduced below: the panorama and the phase difference, which form what will be called the "inter-channel domain" in the continuation of the present document. The panorama of two complex frequency coefficients $c_1$ and $c_2$ is defined as the ratio between the difference in their powers and the sum of their powers:

$$\forall (c_1, c_2) \in \mathbb{C}^2 \mid (c_1, c_2) \neq (0, 0), \text{panorama}(c_1, c_2) = \frac{|c_1|^2 - |c_2|^2}{|c_1|^2 + |c_2|^2} \tag{1}$$

The panorama thus assumes values in the interval [−1,1]. If the two coefficients simultaneously have a nil magnitude, there is no signal in the frequency band that they represent, and the use of the panorama is not relevant.

The panorama applied to a stereophonic signal made up of two left (L) and right (R) channels will thus be, for the respective coefficients of the two channels $c_L$ and $c_R$, not simultaneously nil:

$$\text{panorama}(c_L, c_R) = \frac{|c_L|^2 - |c_R|^2}{|c_L|^2 + |c_R|^2} \tag{2}$$

The panorama is thus equal to, inter alia:

1 for a signal completely contained in the left channel, i.e., $c_R=0$,

−1 for a signal completely contained in the right channel, i.e., $c_L=0$, 0 for a signal of equal magnitude on both channels.

Knowing a panorama and a total power p makes it possible to determine the magnitudes of the two complex frequency coefficients:

$$\begin{cases} |c_L| = \sqrt{p}\sqrt{\frac{1}{2}(1 + \text{panorama})} \\ |c_R| = \sqrt{p}\sqrt{\frac{1}{2}(1 - \text{panorama})} \end{cases} \tag{3}$$

One variant of the formulation of the panorama is as follows:

$$\text{panorama}(c_L, c_R) = \frac{4}{\pi}\text{atan2}(|c_L|, |c_R|) - 1 \tag{4}$$

With this formulation, knowing a panorama and a total power p makes it possible to determine the magnitudes of the two complex frequency coefficients:

$$\begin{cases} |c_L| = \sqrt{p}\sin\left(\frac{\pi}{4}(\text{panorama} + 1)\right) \\ |c_R| = \sqrt{p}\cos\left(\frac{\pi}{4}(\text{panorama} + 1)\right) \end{cases} \tag{5}$$

The phase difference is also defined between two complex frequency coefficients $c_1$ and $c_2$ that are both not nil as follows:

$$\text{phasediff}(c_1,c_2)=\arg(c_2)-\arg(c_1)+k2\pi \tag{6}$$

where $k \in Z$ such that $\text{phasediff}(c_1,c_2) \in ]-\pi, \pi]$.

In the rest of this document, we consider the three-dimensional Cartesian coordinate system with axes (X,Y,Z) and coordinates (x,y,z). The azimuth is considered the angle in the plane (z=0), from the axis X toward the axis Y (trigonometric direction), in radians. A vector v will have an azimuth coordinate a when the half-plane (y=0,x≥0) having undergone a rotation around the axis Z by an angle a will contain the vector v. A vector v will have an elevation coordinate e when, in the half-plane (y=0, x≥0) having undergone a rotation around the axis Z, it has an angle e with a non-nil vector of the half-line defined by intersection between the half-plane and the horizontal plane (z=0), positive toward the top.

An azimuth and elevation unit vector a and e will have, for Cartesian coordinates:

$$\begin{cases} x = \cos(a)\cos(e) \\ y = \sin(a)\cos(e) \\ z = \sin(e) \end{cases} \tag{7}$$

In this Cartesian coordinate system, a signal expressed in the form of a "First Order Ambisonics" (FOA) field, i.e., in first-order spherical harmonics, is made up of four channels W, X Y, Z, corresponding to the pressure and pressure gradient at a point in space in each of the directions:

the channel W is the pressure signal the channel X is the signal of the pressure gradient at the point along the axis X the channel Y is the signal of the pressure gradient at the point along the axis Y the channel Z is the signal of the pressure gradient at the point along the axis Z Normalization standard of the spherical harmonics can be defined as follows: a monochromatic progressive plane wave (MPPW) with complex frequency component c and direction of origin of the unitary vector $\vec{v}$ with Cartesian coordinates $(v_x, v_y, v_z)$ or azimuth and elevation coordinates (a, e) will create, for each channel, a coefficient of equal phase, but altered magnitude:

$$\text{in Cartesian coordinates} \begin{cases} c_w = \frac{c}{\sqrt{2}} & \text{for } W \\ c_x = c\,v_x & \text{for } X \\ c_y = c\,v_y & \text{for } Y \\ c_z = c\,v_z & \text{for } Z \end{cases} \tag{8}$$

or respectively $$\text{in azimuth and elevation coordinates}\begin{cases} c_w = \frac{c}{\sqrt{2}} & \text{for } W \\ c_x = c\cos(a)\cos(e) & \text{for } X \\ c_y = c\sin(a)\cos(e) & \text{for } Y \\ c_z = c\sin(e) & \text{for } Z \end{cases} \quad (9)$$

the whole being expressed to within a normalization factor. By linearity of the time-frequency transforms, the expression of the equivalents in the temporal domain is trivial. Other normalization standards exist, which are for example presented by Daniel in "Representation de champs acoustiques, application à la transmission et à la reproduction de scènes sonores complexes dans un contexte multimédia" [Representation of acoustic fields, application to the transmission and reproduction of complex sound scenes in a multimedia context" (Doctoral Thesis at the Université Paris 6, Jul. 31, 2001).

The concept of "divergence" makes it possible to simulate, in the FOA field, a source moving inside the unitary sphere of the directions: the divergence is a real parameter with values in [0,1], a divergence div=1 will position the source on the surface of the sphere like in the previous equations, and divergence div=0 will position the source at the center of the sphere. Thus, the coefficients of the FOA field are as follows:

$$\text{in Cartesian coordinates}\begin{cases} c_w = \frac{c}{\sqrt{2}} & \text{for } W \\ c_x = c\,div\,v_x & \text{for } X \\ c_y = c\,div\,v_y & \text{for } Y \\ c_z = c\,div\,v_z & \text{for } Z \end{cases} \quad (10)$$

or respectively $$\text{in azimuth and elevation coordinates}\begin{cases} c_w = \frac{c}{\sqrt{2}} & \text{for } W \\ c_x = c\ div\ \cos(a)\cos(e) & \text{for } X \\ c_y = c\ div\ \sin(a)\cos(e) & \text{for } Y \\ c_z = c\ div\ \sin(e) & \text{for } Z \end{cases} \quad (11)$$

the whole being expressed to within a normalization factor. By linearity of the time-frequency transforms, the expression of the equivalents in the temporal domain is trivial.

One preferred implementation of the invention comprises a first conversion method of such a FOA field into complex coefficients and spherical coordinates. This first method allows a conversion, with losses, based on a perceptual nature of the FOA field to a format made up of complex frequency coefficients and their spatial correspondence in azimuth and elevation coordinates (or a unit norm Cartesian vector). Said method is based on a frequency representation of the FOA signals obtained after temporal clipping and time-to-frequency transform, for example through the use of the short-term Fourier transform (STFT).

The following method is applied on each group of four complex coefficients corresponding to a frequency "bin", i.e., the complex coefficients of the frequency representation of each of the channels W, X, Y, Z that correspond to the same frequency band, for any frequency or frequency band from among a plurality of frequencies. An exception is made for the frequency bin(s) corresponding to the continuous component (due to the "padding" applied to the signal before time-to-frequency transform, the following few frequency bins can also be affected).

References $c_W$, $c_X$, $c_Y$, $c_Z$ denote the complex coefficients corresponding to a considered frequency "bin". An analysis is done to separate the content of this frequency band into three parts:

- a part A corresponding to a monochromatic progressive plane wave (MPPW), directional,
- a part B corresponding to a diffuse pressure wave,
- a part C corresponding to a standing wave.

To understand the separation, the following examples are given:

- An analysis leading to a separation in which only part A is non-nil can be obtained with a signal coming from a MPPW as described in equation 8 or equation 9.
- An analysis leading to a separation in which only part B is non-nil can be obtained with two MPPWs (of equal frequency), in phase, and with opposite directions of origin (only $c_W$ then being nil).
- An analysis leading to a separation in which only part C is non-nil can be obtained with two MPPWs (of equal frequency), out of phase, and with opposite directions of origin (only $c_X$, $c_Y$, $c_Z$ then being non-harmed).

Hereinafter, the three parts are grouped together in order to obtain a whole signal.

Regarding part A defined above, the medium-intensity vector of the signal of the FOA field is examined. In "Instantaneous intensity" (AES Convention 81, November 1986), Heyser indicates a formulation in the frequency domain of the active part of the acoustic intensity, which can then be expressed, in all three dimensions:

$$\vec{I}_{x,y,z} = \tfrac{1}{2} = Re[\vec{u}_{x,y,z}^{\,*}] \quad (12)$$

where:

- $\vec{I}_{x,y,z}$ is the medium-intensity three-dimensional vector, oriented toward the origin of the MPPW, of magnitude proportional to the square of the magnitude of the MPPW,
- the operator $Re[\vec{v}]$ designates the real part of the vector $\vec{v}$, i.e., the vector of the real parts of the components of the vector $\vec{v}$,
- p is the complex coefficient corresponding to the pressure component, i.e., $p=\sqrt{2}\,c_W$,
- $\vec{u}_{x,y,z}$ is the three-dimensional vector made up of the complex coefficients corresponding to the pressure gradients respectively along the axis X, Y, and Z, i.e., $\vec{u}_{x,y,z}=(c_X, c_Y, c_Z)^T$,
- the operator $\vec{v}^*$ is the conjugation operator of the complex components of the vector.

One thus obtains for part A, for each frequency "bin" except that or those corresponding to the continuous component:

$$\begin{cases} \vec{a} = Norm\langle \vec{I}_{x,y,z} \mid \vec{0} \rangle & \text{the direction of origin vector} \\ c_a = \|\vec{I}_{x,y,z}\|^{1/2} e^{i\arg(c_W)} & \text{the associated complex coefficient} \end{cases} \quad (13)$$

Furthermore, regarding part B defined above, or the complex component $c_w'$, the result of the subtraction of the complex coefficient corresponding to the signal extracted in part A (i.e., via equation 8) from the original coefficient $c_w$:

$$c'_w = c_w - \frac{c_a}{\sqrt{2}} \tag{14}$$

It is possible to define several behavior modes for the determination of part B:

In a first spherical conversion mode retaining all of the directions of origin at negative elevations, and therefore in particular suitable for virtual reality, part B is expressed as $$\begin{cases} \vec{b} = \vec{r}_w \text{ the direction of origin vector} \\ c_b = c'_w\sqrt{2} \text{ the associated complex coefficient} \end{cases} \tag{15}$$

where $\vec{r}_w$ is a vector depending on the frequency band, described below in the present document.

In a second hemispherical mode, in particular suitable for music, in which the negative elevations are not relevant, the information contained in the hemisphere of the negative elevations is used as divergence in the horizontal plane during decoding, thus for example a source positioned in the middle of the sphere will be lowered to an elevation of −90° in order to obtain a divergence of 0 and therefore spreading over all of the planar speakers after decoding over a circular or hemispherical listening system. Part B is expressed as:

$$\begin{cases} \vec{b} = [\cos(e_w), 0\sin(e_w)]^T \text{ the direction of origin vector} \\ c_b = c'_w\sqrt{2} \text{ the associated complex coefficient} \end{cases} \tag{16}$$

Where $e_w$ is the reintroduction elevation of w, in $[-\pi/2,0]$, chosen by the user, and by default set at $-\pi/2$.

Other modes midway between the first spherical mode and the second hemispherical mode can also be built, indexed by the coefficient $s\in[0,1]$, equal to 0 for the spherical mode, and 1 for the hemispherical mode. Let the vector be the sum:

$$\vec{v}_s=(1-s)\times\vec{r}_w+s\times[\cos(e_w),0, \sin(e_w)]^T \tag{17}$$

One obtains:

$$\begin{cases} \vec{b} = Norm\langle\vec{v}_s \mid [\cos(e_w), 0, \sin(e_w)]^T\rangle \text{ the direction of origin vector} \\ c_b = c'_w\sqrt{2} \text{ the associated complex coefficient} \end{cases} \tag{18}$$

Lastly, regarding part C, let the complex coefficients $c_x'$, $c_y'$, and $c_z'$ be the results of the subtraction of the complex coefficients corresponding to the signal extracted from part A (i.e., the coefficients obtained with the equation) from the original coefficients $c_x$, $c_y$, and $c_z$:

$$\begin{cases} c'_x = c_x - c_a a_x \\ c'_y = c_y - c_a a_y \\ c'_z = c_z - c_a a_z \end{cases} \tag{19}$$

where $a_x$, $a_y$, $a_z$ are the Cartesian coefficients of the vector $\vec{a}$.

One obtains:

$$\begin{cases} \vec{c_x} = \vec{r_x} \text{ the direction of origin vector along the axis } X \\ \quad c_{c,x} = c'_x \text{ the associated complex coefficient} \\ \vec{c_y} = \vec{r_y} \text{ the direction of origin vector along the axis } Y \\ \quad c_{c,y} = c'_y \text{ the associated complex coefficient} \\ \vec{c_z} = \vec{r_z} \text{ the direction of origin vector along the axis } Z \\ \quad c_{c,z} = c'_z \text{ the associated complex coefficient} \end{cases} \tag{20}$$

where $\vec{r}_x$, $\vec{r}_y$, and $\vec{r}_z$ are vectors depending on the frequency or the frequency band, described hereinafter.

The separate parts A, B and C are grouped together in a direction of origin vector $\vec{v}_{total}$ and a complex coefficient $c_{total}$:

$$\begin{cases} \vec{v}_{total} = Norm\langle|c_a|\vec{a} + |c_b|\vec{b} + |c_{c,x}|\vec{c_x} + |c_{c,y}|\vec{c_y} + |c_{c,z}|\vec{c_z}\,|(1, 0, 0)^T\rangle \\ \quad c_{total} = c_a e^{i\arg(c_w)} + c_b e^{i\arg(c_w)} + c_{c,x}e^{i(\arg(c_x)+\phi_x)} + \\ \quad\quad c_{c,y}e^{i(\arg(c_y)+\phi_y)} + c_{c,z}e^{i(\arg(c_z)+\phi_z)} \end{cases} \tag{21}$$

where $\phi_x$, $\phi_y$, and $\phi_0$ are phases that will be defined later in the present document.

The first conversion method described above does not consider any divergence nature that may be introduced during the FOA panoramic. A second preferred implementation makes it possible to consider the divergence nature.

For part A, $\vec{I}_{x,y,z}$ obtained by equation 12 is considered. The divergence div is calculated as follows:

$$\begin{cases} div = \min\left(1, \frac{\|\vec{I}_{x,y,z}\|}{|c_w\sqrt{2}|^2}\right) \text{ if } c_w \neq 0 \\ div = 1 \text{ if } c_w = 0 \end{cases} \tag{22}$$

From div, $c_w$ and $\vec{I}_{x,y,z}$ are calculated $\vec{a}$ and $c_a$:

$$\vec{a_0}=\text{Norm}\langle\vec{I}_{x,y,z}|(0,0,0)^T\rangle \tag{23}$$

In a first spherical embodiment, the unitary direction vector $\vec{a}_{spherical}$ is calculated as follows:

$$\overrightarrow{a_{\text{spherical}}}=\text{Norm}\langle\text{div}\,\vec{a_0}+(1-\text{div})\vec{r_w}|(1,0,0)^T\rangle \tag{24}$$

In a second hemispherical embodiment, the unitary direction vector $\vec{a}_{hemispherical}$ is calculated as follows:

$$\vec{a_1}=\text{div}\,\vec{a_0} \tag{25}$$

One defines $\vec{p}$ the vector $\vec{a}_1$ projected on the horizontal plane:

$$\vec{p}=\vec{a_1}-(\vec{a_1})\cdot(0,0,1)^T \tag{26}$$

where · is the scalar product, and one defines its norm p:

$$p=\|\vec{p}\| \tag{27}$$

One also defines h:

$$h=\sqrt{1-p^2} \tag{28}$$

$$\vec{a}_2=\vec{a}_1-(1-p)(h-\vec{a}_1\cdot(0,0,1)^T)(0,0,1)^T \tag{29}$$

then if the coordinate in Z of $\vec{a}_2$ is less than −h, it is reduced to −h. One defines hdiv:

$$h\ \mathrm{div}=\|\vec{a}_2\| \tag{30}$$

Then lastly $\vec{a}_{hemispherical}$:

$$\overrightarrow{a_{\text{hemispherical}}}=\mathrm{Norm}\langle\vec{a}_2+(1-h\ \mathrm{div})\vec{r}_w|(1,0,0)^T\rangle \tag{31}$$

Modes midway between the spherical mode and the hemispherical mode can be built, indexed by a coefficient s ∈ [0,1], 0 for the spherical mode and 1 for the hemispherical mode:

$$\vec{a}=(1-s)\vec{a}_{spherical}+s\vec{a}_{hemispherical} \tag{32}$$

The complex frequency coefficient is in turn:

$$c_a=c_w\sqrt{2} \tag{33}$$

Furthermore, it will be noted that there is no part B, since the latter is fully taken into account by the divergence in part A.

Lastly, regarding part C, let the complex coefficients $c_x'$, $c_y'$, and $c_z'$ be the results of the subtraction of the complex coefficients corresponding to the signal extracted from part A (i.e., the coefficients obtained with the equation), in its direction without divergence, from the original coefficients $c_x$, $c_y$, and $c_z$:

$$\begin{cases} c_x' = c_x - c_a\ div\ a_{0_x} \\ c_y' = c_y - c_a\ div\ a_{0_y} \\ c_z' = c_z - c_a\ div\ a_{0_z} \end{cases} \tag{34}$$

where $a_{0x}$, $a_{0y}$, $a_{0z}$ are the Cartesian components of the vector $\vec{a}_0$. One obtains:

$$\begin{cases} \vec{c_x} = \vec{r_x} \text{ the direction of origin vector along the axis } X \\ \quad c_{c,x} = c_x' \text{ the associated complex coefficient} \\ \vec{c_y} = \vec{r_y} \text{ the direction of origin vector along the axis } Y \\ \quad c_{c,y} = c_y' \text{ the associated complex coefficient} \\ \vec{c_z} = \vec{r_z} \text{ the direction of origin vector along the axis } Z \\ \quad c_{c,z} = c_z' \text{ the associated complex coefficient} \end{cases} \tag{35}$$

where $\vec{r}_x$, $\vec{r}_y$, and $\vec{r}_z$ are vectors depending on the frequency band, described hereinafter.

The separate parts A and C are definitively grouped together in a direction of origin vector $\vec{v}_{total}$ and a complex coefficient $c_{total}$:

$$\begin{cases} \vec{v}_{total} = Norm\langle|c_a|\vec{a} + |c_{c,x}|\vec{c_x} + |c_{c,y}|\vec{c_y} + |c_{c,z}|\vec{c_z}\,|\,(1,0,0)^T\rangle \\ c_{total} = c_a e^{i\arg(c_w)} + c_{c,x}e^{i(\arg(c_x)+\phi_x)} + c_{c,y}e^{i(\arg(c_y)+\phi_y)} + c_{c,z}e^{i(\arg(c_z)+\phi_z)} \end{cases} \tag{36}$$

where $\phi_x$, $\phi_y$ and $\phi_z$ are phases that will be defined later in the present document.

Regarding the direction vectors for the diffuse parts, reference is made above to:

vectors $\vec{r}_w$, $\vec{r}_x$, $\vec{r}_y$, $\vec{r}_z$, and phases $\phi_x$, $\phi_y$ and $\phi_z$.

These vectors and phases are responsible for establishing a diffuse nature of the signal, to which they give the direction and of which they modify the phase. They depend on the processed frequency band, i.e., there is a vector and phase set for each frequency "bin". In order to establish this diffuse nature, they result from a random process, which makes it possible to smooth them spectrally, and temporally if it is desired for them to be dynamic.

The process of obtaining these vectors is as follows:

For each frequency or frequency band, a set of unitary vectors $\vec{r}_{0w}$, $\vec{r}_{0x}$, $\vec{r}_{0y}$, $\vec{r}_{0z}$, and phases $\phi_{0x}$, $\phi_{0y}$ and $\phi_{0z}$ are generated from a pseudorandom process:

the unitary vectors are generated from an azimuth derived from a uniform real number pseudorandom generator]−π, π] and an elevation derived from the arcsine of a real number from a uniform pseudorandom generator in [−1,1];

the phases are obtained using a uniform pseudorandom generator of real numbers in]−π, π], The frequencies or frequency bands are swept from those corresponding to the low frequencies toward those corresponding to the high frequencies, to spectrally smooth the vectors and phases using the following procedure:

For the vectors $\vec{r}_w$ (b) where b is the index of the frequency or the frequency band, $$\begin{cases} \vec{r_w}(b=0) = \vec{r_{0_w}}(0) \\ \vec{r_w}(b>0) = Norm\langle\vec{r_w}(b-1) + \tau\vec{r_{0_w}}(b)|(1,0,0)^T\rangle \end{cases} \tag{37}$$

where τ is the frequency equivalent of a characteristic time, allowing the user to choose the spectral smoothing of the diffuse nature; one possible value for a sampling frequency of 48 kHz, a window size of 2048 and a padding of 100% is 0.65.

The vectors $\vec{r}_x$, $\vec{r}_y$, $\vec{r}_z$ according to the same procedure from $\vec{r}_{0x}$, $\vec{r}_{0y}$, $\vec{r}_{0z}$ respectively.

For the phases $\phi_x$(b) where b is the index of the frequency or the frequency band, $$\begin{cases} \phi_x(b=0) = \phi_{0_x}(0) \\ \phi_x(b>0) = \arg\left(e^{i\phi_x(b-1)} + \tau e^{\phi_{0_x}(b)}\right) \end{cases} \tag{38}$$

where τ is derived from the same considerations as for the vectors.

The phases $\phi_y$ and $\phi_z$ according to the same procedure from $\phi_{0y}$ and $\phi_{0z}$ respectively.

If a dynamic process is desired, during the generation of new vectors $\vec{r}_{0w}$, $\vec{r}_{0x}$, $\vec{r}_{0y}$, $\vec{r}_{0z}$ and new phases $\phi_{0x}$, $\phi_{0y}$, $\phi_{0z}$ the old vector and the old phase are kept in a manner similar to the stated processes, using a characteristic time parameter.

The vectors of the lowest frequencies, for example those corresponding to the frequencies below 150 Hz, are modified to be oriented in a favored direction, for example and preferably $(1,0,0)^T$. To that end, the generation of the random vectors $\vec{r}_{0w}$, $\vec{r}_{0x}$, $\vec{r}_{0y}$, $\vec{r}_{0z}$ is modified: it then consists of generating a random unitary vector, determining a vector $(m\ n^b,\ 0,0)^T$ where m is a factor greater than 1, for example 8, and n is a factor of less than 1, for example 0.9, making it possible to decrease the preponderance of this vector relative to the random unitary vector when the index b of the frequency bin increases.

summing and normalizing the obtained vector.

The spectral smoothing to obtain vectors $\vec{r}_w$, $\vec{R}_x$, $\vec{r}_y$, $\vec{r}_x$ is unchanged.

As an alternative to the procedure for generating random vectors, the vectors $\vec{r}_w$, $\vec{r}_x$, $\vec{r}_y$, $\vec{r}_x$, and phases $\phi_x$, $\phi_y$ and $\phi_z$ can be determined by impulse response measurements: it is possible to obtain them by analyzing complex frequency coefficients derived from multiple sound captures of the first-order spherical field, using signals emitted by speakers, in phase all the way around the measurement point for $\vec{r}_w$, on either side and out of phase along the axes X, Y, and Z for $\vec{r}_x$, $\vec{r}_y$ and $\vec{r}_x$ respectively and $\phi_x$, $\phi_y$ and $\phi_z$ respectively.

For the frequency (frequencies) or frequency band(s) corresponding to the continuous component, the processing is separate. It will be noted that due to the padding, the continuous state corresponds to one or more frequencies or frequency bands:

if there is no padding, only the first frequency or frequency band undergoes the processing as defined below;

if there is 100% padding (which therefore doubles the length of the signal before time-to-frequency transform), the first two frequencies or frequency bands are subject to application of the processing as defined below (as well as the "negative" frequency or frequency band, which is conjugate-symmetrical with respect to the second frequency or frequency band);

if there is 300% padding (which therefore quadruples the length of the signal before time-to-frequency transform), the first four frequencies or frequency bands are subject to application of the processing as defined below (as well as the "negative" frequencies or frequency bands, which are conjugates-symmetrical with respect to the second, third and fourth frequencies or frequency bands);

the other padding cases follow the same logic.

This or these frequencies or frequency bands have a real and non-complex value, which does not make it possible to determine the phase of the signal for the corresponding frequencies; the direction analysis is therefore not possible. However, as shown by the psychoacoustic literature, a human being cannot perceive a direction of origin for the low frequencies in question (those below 80 to 100 Hz, in the case at hand). It is thus possible only to analyze the pressure wave, therefore the coefficient $c_w$, and to choose an arbitrary, frontal direction of origin: $(1,0,0)^T$. Thus, the representation in the spherical domain of the first frequency band(s) is:

$$\begin{cases} \overrightarrow{v_{total}} = (1,0,0)^T \\ c_{total} = c_w\sqrt{2} \end{cases} \tag{39}$$

In order to guarantee the correspondence between spherical coordinates and the inter-channel domain, the Scheiber sphere, corresponding, in the optics field, to the Stokes-Poincaré sphere, is used hereinafter.

The Scheiber sphere symbolically represents the magnitude and phase relations of two monochromatic waves, i.e., also two complex frequency coefficients representing these waves. It is made up of two half-circles joining the opposite points L and R, each half-circle being derived from a rotation around the axis LR of the frontal arc in bold by an angle β and representing a phase difference value $\beta \in ]-\pi, \pi]$. The frontal half-circle represents a nil phase difference. Each point of the half-circle represents a distinct panorama value, with a value close to 1 of the points close to L, and a value close to −1 for the points close to R.

FIG. 1 illustrates the principle of the Scheiber sphere. The Scheiber sphere (100) symbolically represents, using points on a sphere, the magnitude and phase relations of two monochromatic waves, i.e., also of two complex frequency coefficients representing these waves, in the form of half-circles of equal phase difference and indexed on the panorama. Peter Scheiber established, in "Analyzing Phase-Amplitude Matrices" (JAES, 1971), that it was possible to make this sphere, built symbolically, match the sphere of physical positions of sound sources, allowing spherical encoding of the sound sources. He chose to adopt this correspondence, preferably by assigning the positive phase difference meridians to the negative elevations, this making it possible to guarantee a certain compatibility with the traditional mastered surround signals a simple sign change makes it possible to obtain an inverse convention, inverting the positive and negative elevations. Thus, the axis LR (101, 102) becomes the axis Y (103), the axis X (105) pointing toward the half-circle (104) with a nil phase difference.

Regarding the conversion from the inter-channel domain to the spherical coordinates, the coordinate system of the Scheiber sphere is spherical with polar axis Y, and it is possible to express the coordinates in X, Y, Z as a function of the panorama and the phase difference:

$$\begin{cases} x = \cos\left(\frac{\pi}{2}\text{panorama}\right)\cos(phasediff) \\ y = \sin\left(\frac{\pi}{2}\text{panorama}\right) \\ z = -\cos\left(\frac{\pi}{2}\text{panorama}\right)\sin(phasediff) \end{cases} \tag{40}$$

The azimuth and elevation spherical coordinates for such Cartesian coordinates are obtained by the following method:

$$\begin{cases} a = a\tan2(y, x) = a\tan2\begin{pmatrix} \sin\left(\frac{\pi}{2}\text{panorama}\right), \cos\left(\frac{\pi}{2}\text{panorama}\right) \\ \cos(phasediff) \end{pmatrix} \\ e = \arcsin(z) = \arcsin\left(-\cos\left(\frac{\pi}{2}\text{panorama}\right)\sin(phasediff)\right) \end{cases} \tag{41}$$

Thus, given a pair of complex frequency coefficients, their relationship establishing a panorama and a phase difference, it is possible to determine a direction of origin of a sound signal on a sphere. This conversion also makes it possible to determine the magnitude of the complex frequency coefficient of the monophonic signal, but the determination of its phase is not established by the above method and will be specified hereinafter.

It is possible to obtain the reciprocal of the conversion previously described, i.e., the conversion from the spherical coordinates to the inter-channel domain:

$$\begin{cases} \text{panorama} = \frac{2}{\pi}\arcsin(y) \\ phasediff = -a\tan2(z, x) \end{cases} \quad (42)$$

or, in spherical coordinates:

$$\begin{cases} \text{panorama} = \frac{2}{\pi}\arcsin(\sin(a)\cos(e)) \\ phasediff = -a\tan2(\sin(e), \cos(a)\cos(e)) \end{cases} \quad (43)$$

Thus, given the complex coefficient of a monophonic signal and its direction of origin, it is possible to determine the magnitudes of two complex coefficients as well as their phase difference, but, as seen above, the determination of their absolute phase is not established by the above method.

According to the presentation done by Peter Scheiber in "Analyzing Phase-Amplitude Matrices" (JAES, 1971), the azimuths 90° and −90° correspond to the left (L) and right (R) speakers, which are typically located respectively at the azimuths 30° and −30° on either side facing the listener. Thus, to respect this spatial correspondence, which naturally allows a compatibility with the stereo and mastered surround formats, a conversion to the spherical domain can be followed by an affine modification by segments of the azimuth coordinates:

- any azimuth a∈[−90°, 90° ] is stretched in the interval [−30°, 30° ] in an affine manner,
- any azimuth a∈[90°, 180° ] is stretched in the interval [30°, 180° ] in an affine manner,
- any azimuth a∈]−180°, 90° ] is stretched in the interval]−180°, 30° ] in an affine manner.

To follow the same principle, a conversion from the spherical domain can then naturally be preceded by the inverse conversion:

- any azimuth a∈[−30°, 30° ] is stretched in the interval [−90°, 90° ] in an affine manner,
- any azimuth a∈[30°, 180° ] is stretched in the interval [90°, 180° ] in an affine manner,
- any azimuth a∈] 180°, 30° ] is stretched in the interval]−180°, 90° ] in an affine manner.

Figure 13:
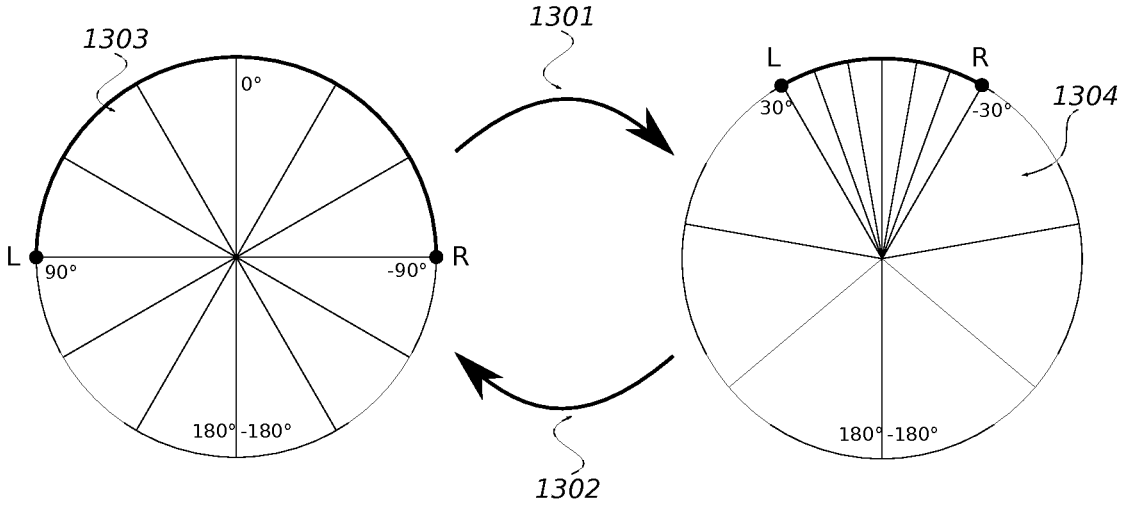
FIG. 13 illustrates the deformation process of the spherical space according to the azimuth values.

In "Understanding the Scheiber Sphere" (MCS Review, Vol. 4, No. 3, Winter 1983), Sommerwerck illustrates this principle of correspondence between physical space and Scheiber sphere, said principle therefore being obvious to any person in light of the state of the art. These azimuth conversions are illustrated in FIG. 13, which gives the principle of the operations (1301) and (1302) providing for said affine modifications.

In the context of the determination of the phase correspondence, the objective is to produce a fully determined correspondence between a pair of complex frequency coefficients (inter-channel domain) on the one hand and a complex frequency coefficient and spherical coordinates on the other hand (spherical domain).

As seen above, the correspondence previously established does not make it possible to determine the phase of the complex frequency coefficients, but only the phase difference in the pair of complex frequency coefficients of the inter-channel domain.

It is then a matter of determining the appropriate correspondence for the phases, i.e., how to define the phase of a coefficient in the spherical domain as a function of the position in the inter-channel domain (panorama, phasediff), as well as the absolute phase of said coefficients (which will be represented by an intermediate phase value, as will be seen later).

A representation is established of a phase correspondence in the form of a two-dimensional map of the phases in the inter-channel domain, with the panorama on the x-axis on the value domain [−1,1], and the phase difference on the y-axis in the value domain]−π, π]. This map shows the pairs of complex coefficients of the inter-channel domain obtained from a conversion from a coefficient of the spherical domain:

- having a phase ϕ=0, the other input and output phases being obtained to within an identical rotation,
- having spherical coordinates, which are bijective with a panorama and a phase difference, chosen hereinafter as coordinates of the map.

The pairs of coefficients are shown locally, the map therefore shows a field of complex coefficient pairs. The choice of a phase correspondence corresponds to the local rotation of the complex plane containing the pair of complex frequency coefficients. One can see that the map is a two-dimensional representation of the Scheiber sphere, to which the phase information is added.

Figure 2:
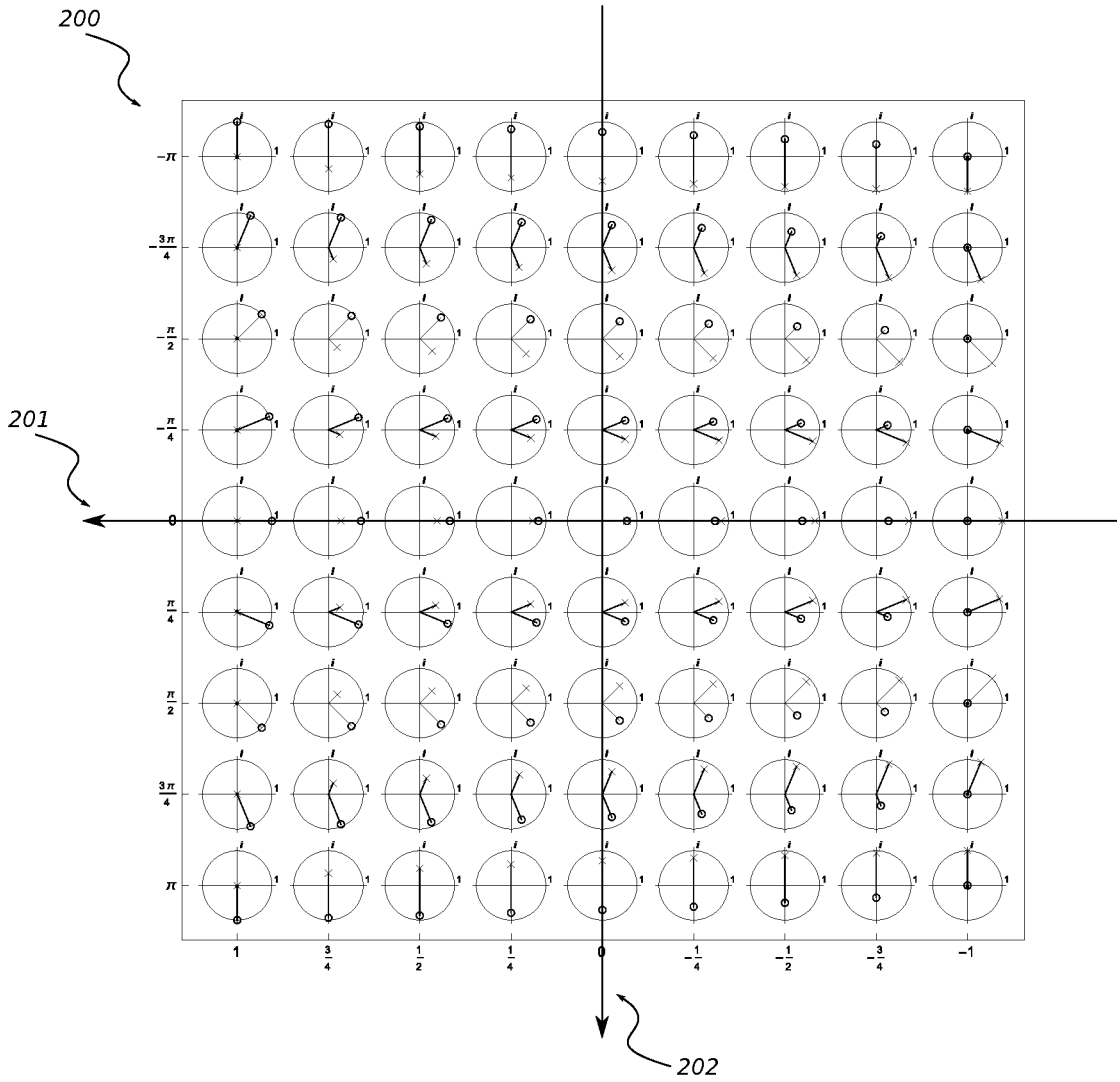
FIG. 2 illustrates, in panoramic-phase map form, an example of arbitrary phase correspondence choice.

FIG. 2 illustrates an example correspondence map (200) of the phases between the spherical domain and the inter-channel domain, showing, for different panorama measurements on the x-axis (201) and phase difference measurements on the y-axis (202), an arbitrary phase correspondence choice that is simply the subtraction of half the phase difference for the channel L and the addition of half the phase difference for the channel R. The x-axis (201) is inverted so that the left lateral positions correspond to a preponderant power signal in the channel L and respectively for the right side and the channel R The y-axis (201) is also inverted for the hemisphere with positive elevation, or the top half of the figure. The field of complex coefficient pairs is shown in complex plane sections around the origin; in each coordinate system, the complex frequency coefficient $c_L$ is represented by a vector, the apex of which is a circle, the complex frequency coefficient $c_R$ is represented by a vector, the apex of which is an x. This phase correspondence map is not usable, since it violates the principles set out hereinafter.

The criterion chosen to design a correspondence is that of spatial continuity of the phase of the signal, i.e., that an infinitesimal change in position of a sound source must result in an infinitesimal change of the phase. The phase continuity criterion imposes constraints for a phase correspondence at the edges of the domain:

- the top and bottom of the domain are, for looping of the phase to within 2π, adjacent. Thus, the values must be identical at the top and bottom of the domain.
- all of the values to the left of the domain (respectively all of the values to the right of the domain) correspond to the vicinity of the point L (respectively the point R) of the sphere of the locations. To guarantee the continuity around these points on the sphere, the phase of the complex frequency coefficient having the greatest magnitude must be constant. The phase of the complex frequency coefficient having the smallest magnitude is then imposed by the phase difference; it performs a rotation of 2π when a curve is traveled around the points L or R of the sphere, but this is not problematic, since the magnitude is canceled out at the phase discontinuity point, leading to continuity of the complex frequency coefficient.

Figure 3:
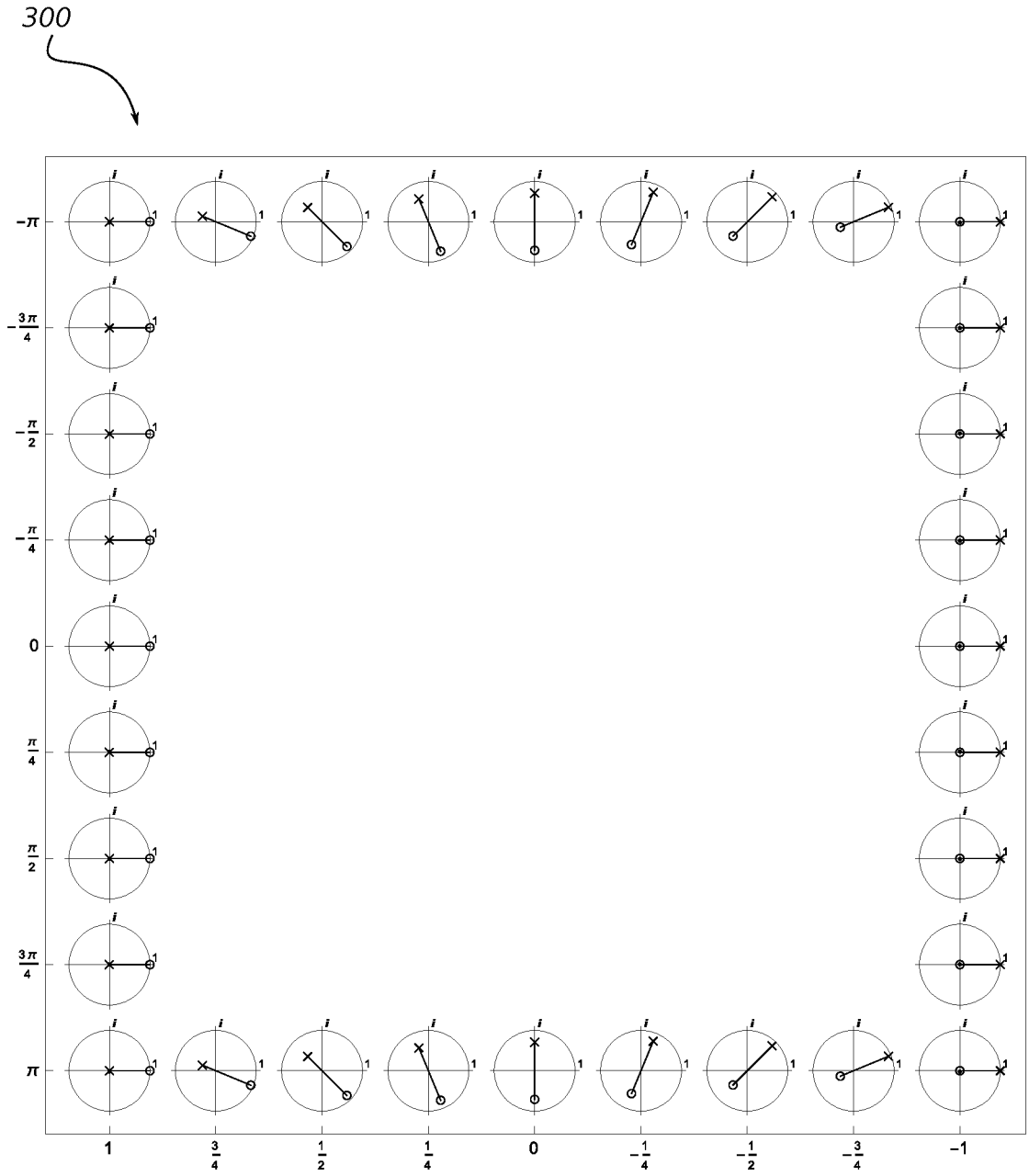
FIG. 3 provides an example of partial phase correspondence map providing continuity between the edges of the panoramic-phase definition domain.

FIG. 3 provides an example of phase correspondence that may be built according to these constraints, to guarantee phase continuity at the edges of the map (300). The consistency of the phase value is guaranteed on each of the lateral edges, and there is equality of the values by the correspondence of the top and bottom of the domain. This solution not being unique, other correspondence maps are possible. Let us establish whether it is possible to define a continuous map of the phases. It is possible to "fold" the phase correspondence map on the Scheiber sphere, which is also the spatial position sphere:

- by gluing the top and bottom edges together on the half-circle opposite the frontal half-circle,
- by pinching the left and right sides each around its corresponding point L or R.

Figure 4:
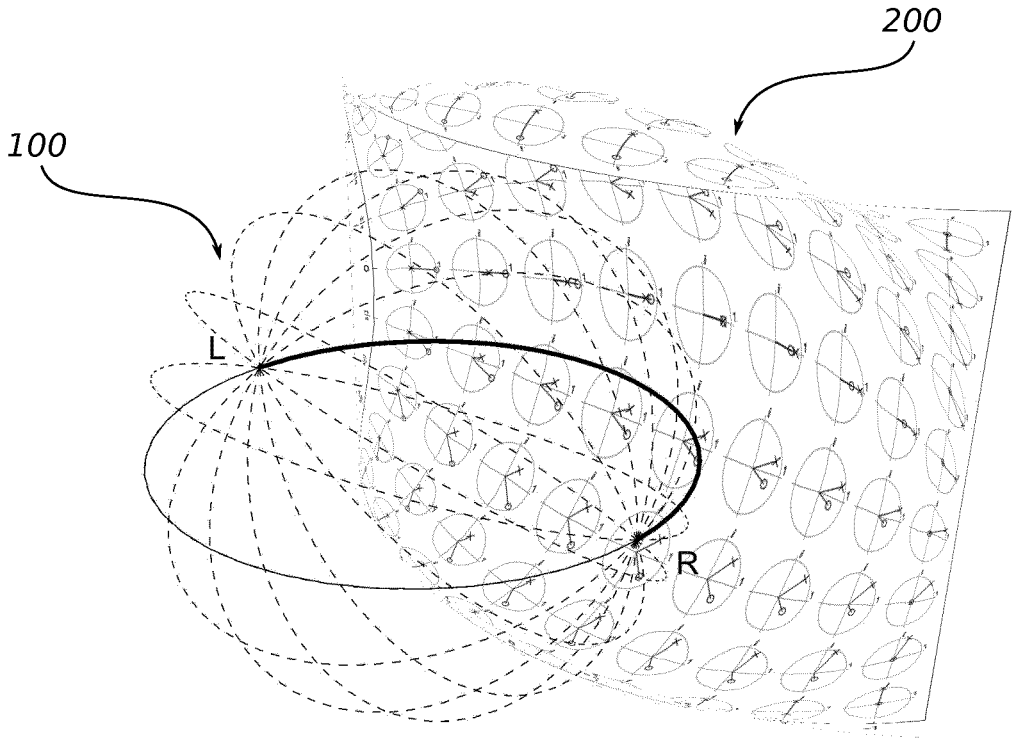
FIG. 4 illustrates the principle of folding of the correspondence map of FIG. 2 on the Scheiber sphere of FIG. 1.
Figure 5:
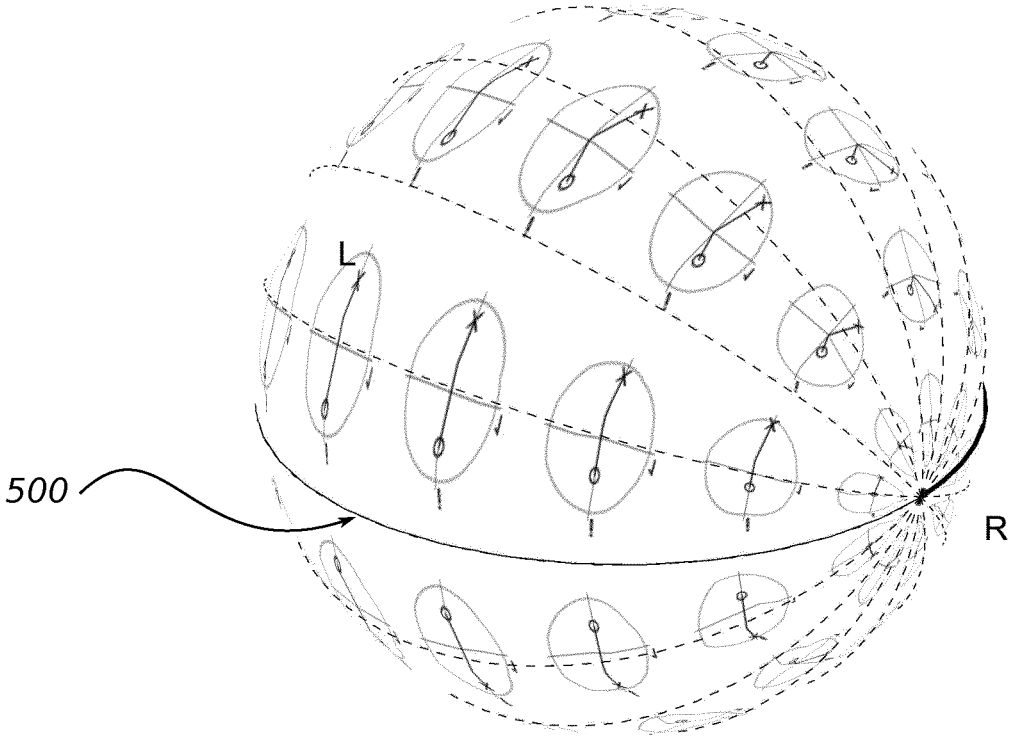
FIG. 5 illustrates the folding of FIG. 4, once it is done completely.

FIG. 4 illustrates how the two-dimensional map (200) of FIG. 2 is folded on the Scheiber sphere (100) of FIG. 1. The directions of the local coordinate systems are kept by the folding; the local coordinate systems thus have their continuous direction on the sphere, except at the points L and R, but this is not a problem because the phase continuity is already guaranteed at these points. Two complex coefficient fields are thus obtained for a correspondence map. These complex coefficients correspond to vectors tangent to the sphere, except at the points L and R. It will be noted that the map (200), once completely folded as illustrated in FIG. 5, has, on the rear arc (thin continuous line) (500), a phase discontinuity, this discontinuity being resolved by the method illustrated in FIG. 3.

Hereinafter we consider the field of tangent vectors generated by the coefficient of the left channel $c_L$; the considerations are identical for the field of tangent vectors generated by the coefficient of the right channel $c_R$. For the considerations of the demonstration, we modify the field of vectors in the immediate vicinity of L using a real factor that cancels it out at L, in order to guarantee the continuity of the vector field; this in no way modifies the phases and therefore the correspondence of the phases.

Figure 6:
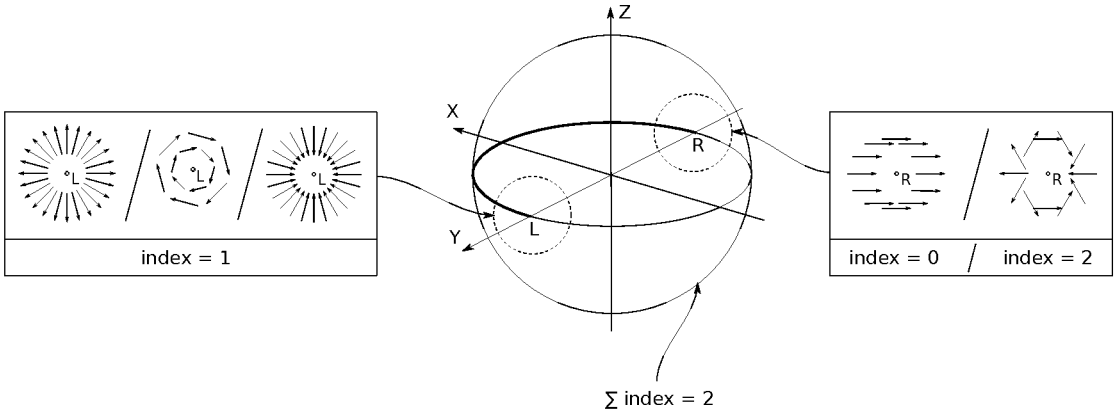
FIG. 6 shows the Scheiber sphere on which a vector field is present corresponding to the local complex frequency coefficient $c_L$. By construction of the phase correspondence map, the sum of the indices with the authorized singularities, in L, or cancellation of the vector field, in R, is different from 2, value expected if it was possible not to have another singularity on the sphere. The left and right boxes show the possible local structures of the vector field near singularities of the points L and R, with their respective indices.

According to the Poincaré-Hopf theorem, the sum of the zero indices isolated from the vector field is equal to the Euler-Poincaré characteristic of the surface. In the case at hand, a vector field on a sphere has a Euler-Poincaré characteristic of 2. Yet by construction, the vector field derived from $c_L$ cancels itself out through the modification around L with an index 1, as can be seen in FIG. 6. The sum of the indices is therefore odd, which requires at least one other zero in the vector field, with an appropriate index so that the sum of the indices is equal to the Euler-Poincaré characteristic. This zero not being possible by construction of the Scheiber sphere, the magnitudes of the complex coefficients not being alterable, this requires at least one additional discontinuity in the field of complex coefficients $c_L$. In conclusion, it is not possible to establish a phase correspondence that is continuous over the entire Scheiber sphere.

The method disclosed in the present invention resolves this issue of phase continuity. It is based on the observation that in real cases, the entire sphere is not fully and simultaneously traveled over by signals. A phase correspondence discontinuity located at one point of the sphere traveled by signals (fixed signals or spatial trajectories of signals) will cause a phase discontinuity. A phase correspondence discontinuity located at one point of the sphere not traveled by signals (fixed signals or spatial trajectories of signals) does not cause a phase discontinuity. Without a priori knowledge of the signals, a discontinuity at a fixed point will not be able to guarantee that no signal will pass through that point. A discontinuity at a moving point may, however, "avoid" being traveled by a signal, if its location depends on the signal. This moving discontinuity point may be part of a dynamic phase correspondence that is continuous over any other point of the sphere. The principle of dynamic phase correspondence based on avoidance of the spatial location of the signal by the discontinuity is thus established. We will establish such a phase correspondence based on this principle, other phase correspondences being possible.

A phase correspondence Φ (panorama, phasediff) function is defined that is used in both conversion directions, from the inter-channel domain to the spherical domain and in the reverse direction; the panorama and the phase difference are obtained in the original domain or in the arrival domain of these two conversions as previously indicated. This function describes the phase difference between the spherical domain and the inter-channel domain:

$$\Phi(\text{panorama},\text{phasediff})=\phi_s-\phi_i \tag{44}$$

where $\phi_s$ the phase of the complex frequency coefficient of the spherical domain, and $\phi_i$ is the intermediate phase of the inter-channel domain:

$$\phi_i=\arg(c_L)+\tfrac{1}{2}\text{phasediff}=\arg(c_R)-\tfrac{1}{2}\text{phasediff} \tag{45}$$

where $c_L$ and $c_R$ are the complex frequency coefficients of the inter-channel domain. The phase correspondence function is dynamic, i.e., it varies from one temporal window to the next. This function is built with a dynamic singularity, situated at a point $\Psi=(\text{panorama}_{singularity}, \text{phasediff}_{singularity})$ of the inter-channel domain defined by a panorama value $\text{panorama}_{singularity}$ in $[-\tfrac{1}{2}, \tfrac{1}{2}]$ and phase difference value $\text{phasediff}_{singularity}$ in $]-\pi, -\pi/2]$. This corresponds to a zone situated behind the listener, at a slight height. It is possible to choose other zones at random. The singularity is initially located at the center of said zone, at a position $\Psi_0$ that is called "anchor" hereinafter. It is possible to choose other initial locations of the anchor at random within said zone. The choice of panorama and phase difference corresponding to the singularity are noted in the index of the phase correspondence function. A formulation of a phase correspondence function creating only one singularity is as follows:

If $\text{phasediff}\geq-\pi/2$:

$$\Phi_\Psi(\text{panorama},\text{phasediff})=-\tfrac{1}{2}\text{panorama phasediff} \tag{46}$$

If $\text{phasediff}\leq-\pi/2$ and $\text{panorama}\leq-\tfrac{1}{2}$:

$$\Phi_\Psi(\text{panorama},\text{phasediff})=-\tfrac{1}{2}\text{panorama phasediff}+(\text{panorama},+1)(2\text{phasediff}+\pi) \tag{47}$$

If $\text{phasediff}\leq-\pi/2$ and $\text{panorama}\geq\tfrac{1}{2}$:

$$\Phi_\Psi(\text{panorama},\text{phasediff})=-\tfrac{1}{2}\text{panorama phasediff}+(\text{panorama},-1)(2\text{phasediff}+\pi) \tag{48}$$

If $\text{phasediff}\leq-\pi/2$ and panorama $e]-\tfrac{1}{2}, \tfrac{1}{2}[$, i.e., if the coordinates of the point are inside the zone of the singularity, then its coordinates are projected from the point Ψ on the edge of the zone, and the preceding formulas are used with the coordinates of the projected point. If the point is situated exactly on Ψ despite the precautions, any point of the edge of the zone can be used.

In order to prevent the point of the singularity Ψ from being situated, spatially speaking, close to a signal, it is moved in the zone in order to "flee" the location of the signal, processing window after processing window. To that end, preferably before calculating the phase correspondence, all of the frequency bands are analyzed in order to determine their respective panorama and phase difference location in the inter-channel domain, and for each one, a change vector is calculated, intended to move the point of the singularity. For example, in a favored implementation of the present invention, the change resulting from a frequency band can be calculated as follows:

$$f_\Psi(\text{panorama}, phasediff) = +\frac{1}{N}\min\left(\frac{1}{4}, \frac{1}{100\,d^2}\right) \tag{49}$$

As norm of the change vector, where N is the number of frequency bands and d is the distance between the point Ψ and the point of coordinates (panorama, phasediff), if d≠0, 0 otherwise, and $$\overrightarrow{u_\Psi}(\text{panorama}, phasediff) = \frac{\Psi - (\text{panorama}, phasediff)^T}{d} \tag{50}$$

As direction of the change vector, if d≠0, $\vec{0}$ otherwise. Preferably, for better avoidance of the trajectories, it is possible to apply a slight rotation in the plane to $\vec{u}_\Psi$ (panorama, phasediff), for example of π/16 for a sampling frequency of 48000 Hz, for sliding windows of 2048 samples and 100% padding (the value of the rotation angle being adapted based on these factors), useful for example when a source has a linear trajectory that passes through the point $\Leftrightarrow_0$, so that the singularity bypasses the source on one side. The change vector is then:

$$\vec{F}_\Psi(\text{panorama,phasediff}) = f_\Psi(\text{panorama,phasediff})\,\vec{u}_\Psi(\text{panorama,phasediff}) \tag{51}$$

The change vectors derived from all of the frequency bands are next added, and to this sum, a vector to return the singularity to the anchor $\Psi_0$ is added, formulated for example as follows:

$$\vec{F}_{\Psi_0} = \tfrac{1}{10}(\Psi_0 - \Psi) \tag{52}$$

where the factor 1/10 is modified according to the sampling frequency, the size of the window and the padding rate like for the rotation. The resulting change vector $\Sigma\,\vec{F}$ is applied to the singularity in the form of a simple vector addition to a point:

$$\Psi \leftarrow \Psi + \Sigma\vec{F} \tag{53}$$

Figure 7:
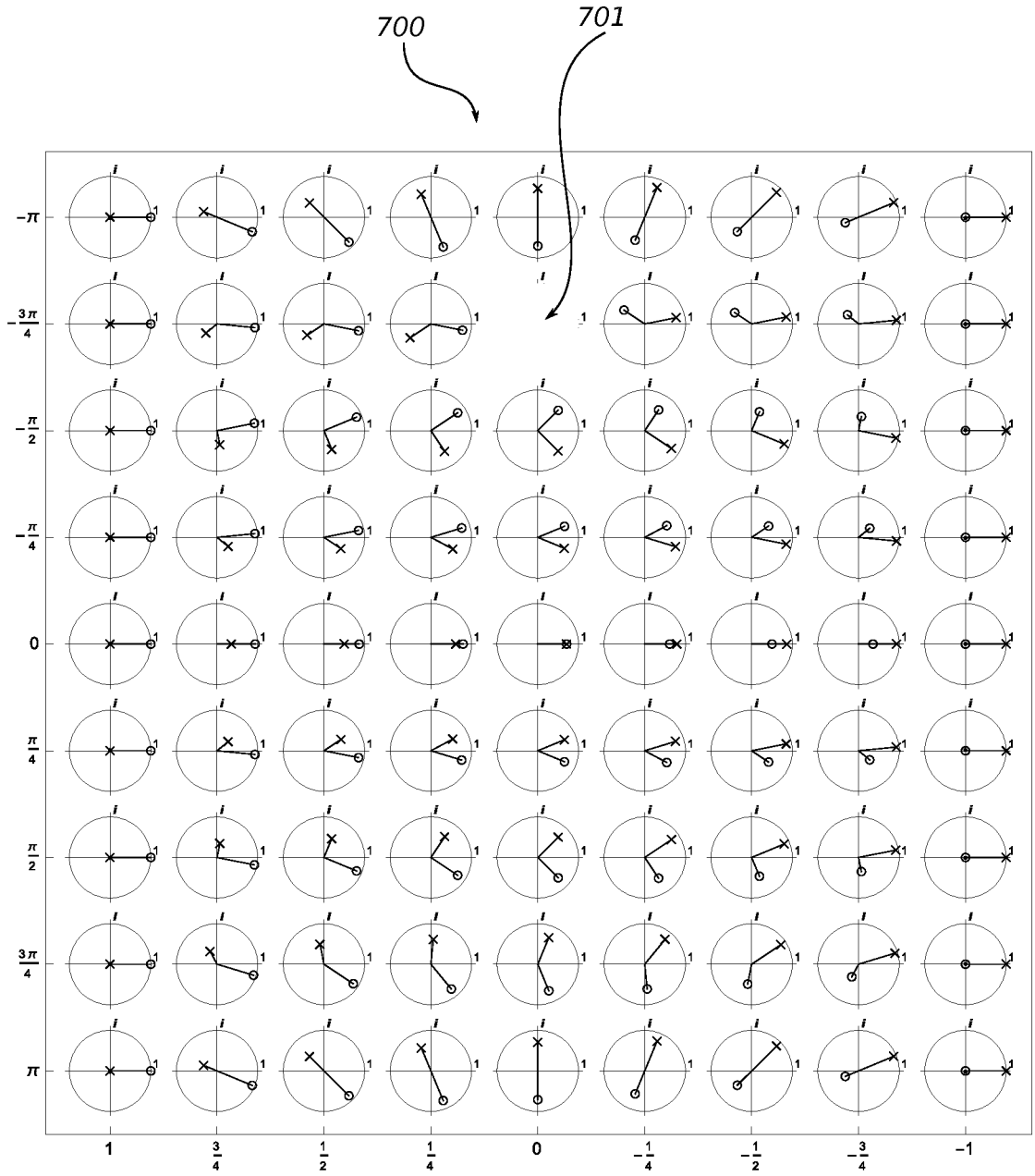
FIG. 7 illustrates the phase correspondence for a singularity position in $\Psi=\Psi_0$. The phase correspondence described by this map is continuous all points except at $\Psi$.
Figure 8:
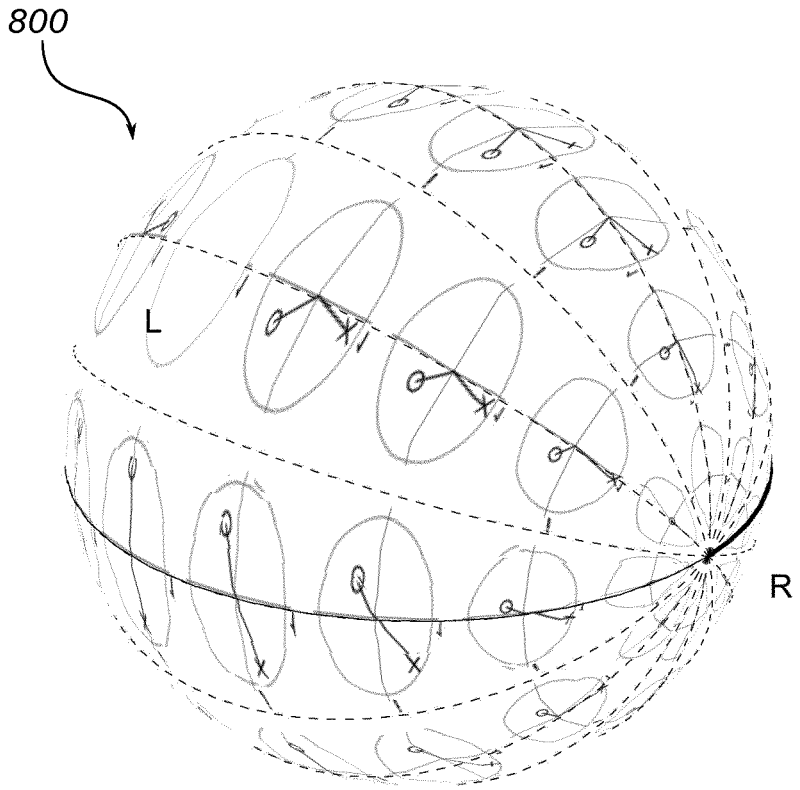
FIG. 8 shows the map of FIG. 7 after its folding on the Scheiber sphere.

Thus, when idle, one obtains the phase correspondence map (700) of FIG. 7, for which the singularity is set at the coordinates $\Psi_0=(0, -3\pi/4)$. FIG. 8 shows the phase correspondence map of FIG. 7 once folded on the Scheiber sphere.

Figure 9:
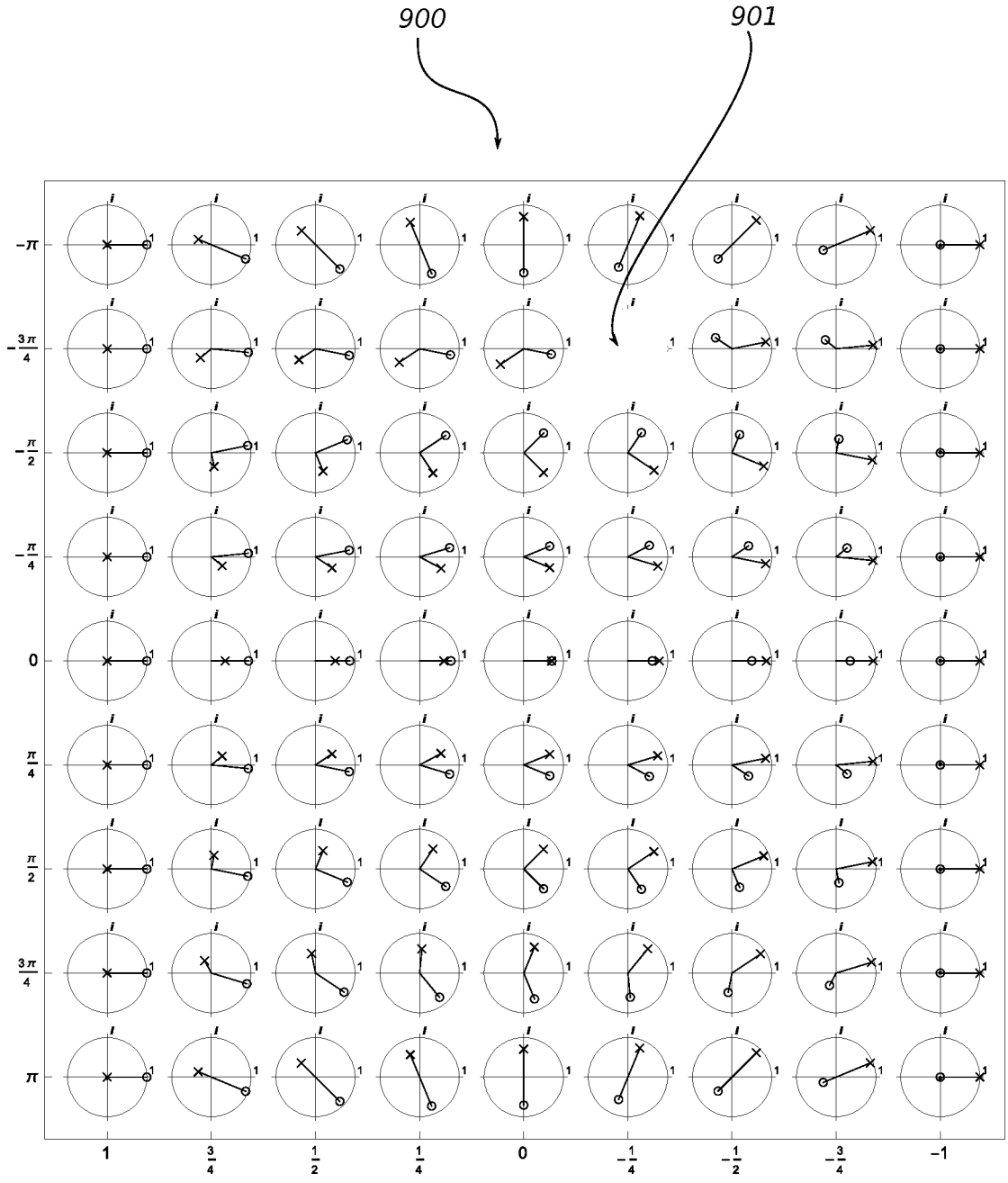
FIG. 9 illustrates the phase correspondence map for a singularity positioned in with panorama and phase difference coordinates $(-\frac{1}{4}, -3\pi/4)$.
Figure 10:
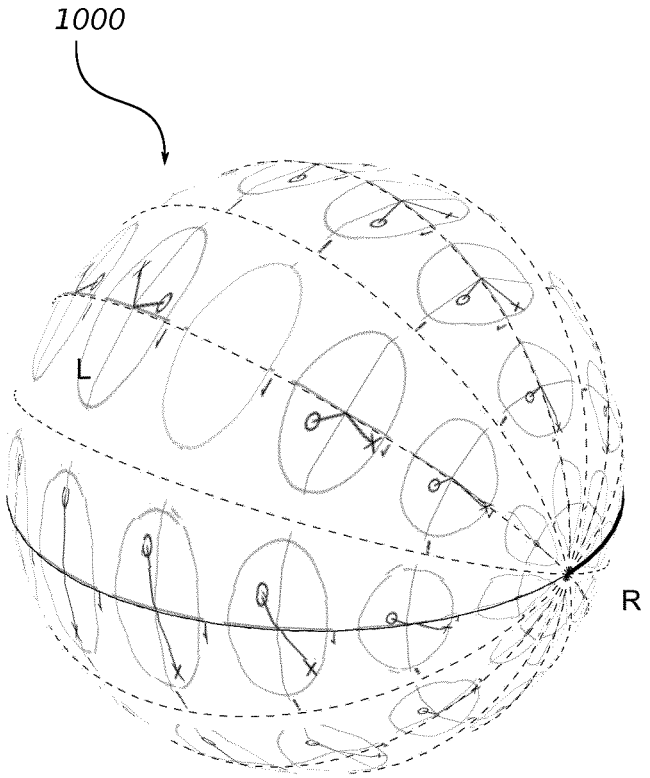
FIG. 10 shows the map of FIG. 9 after its folding on the Scheiber sphere.

FIG. 9 shows the phase correspondence map if ¶ has panorama and phase difference coordinates (−¼, −3π/4). The phase correspondence described by this map is continuous everywhere except at Ψ. FIG. 10 shows the phase correspondence map of FIG. 9, once folded on the Scheiber sphere.

As described above in the present document, a signal expressed in the spherical domain is characterized, for any frequency or frequency band, by an azimuth and an elevation, a magnitude and a phase.

Implementations of the present invention include a means for transcoding from the spherical domain to a given audio format chosen by the user. Several techniques are presented as examples, but their adaptation to other audio formats will be trivial for a person familiar with the state of the art of sound rendering or encoding of the sound signal.

A first-order spherical harmonic (or First-Order Ambisonic, FOA) transcoding may be done in the frequency domain. For each complex coefficient c corresponding to a frequency band, knowing the corresponding azimuth a and elevation e, four complex coefficients w, x, y, z corresponding to the same frequency band can be generated using the following formulas:

$$\begin{cases} w = \dfrac{c}{\sqrt{2}} \\ x = c.\cos(a)\cos(e) \\ y = c.\sin(a)\cos(e) \\ z = c.\sin(e) \end{cases} \tag{54}$$

The coefficients w, x, y, z obtained for each frequency band are assembled to respectively generate frequency representations W, X, Y and Z of four channels, and the application of the frequency-to-time transform (inverse of that used for the time-to-frequency transform), any clipping, then the overlap of the successive time windows obtained makes it possible to obtain four channels that are a first-order spatial harmonic temporal representation of the three-dimensional audio signal. A similar approach can be used for transcoding to a format (HOA) of an order greater than or equal to 2, by completing equation (54) with the encoding formulas for the considered order.

Transcoding to a surround 5.0 format including five left, center, right, rear left and rear right channels can be done as follows.

For each frequency or frequency band, the coefficients $c_L$, $c_c$, $c_R$, $c_{Ls}$, $c_{Rs}$ respectively corresponding to the speakers usually called L, C, R, Ls, Rs, are calculated as follows, from azimuth and elevation coordinates a and e of the direction of origin vector and the complex frequency coefficient $c_s$. The gains $g_L$, $g_R$, $g_{Ls}$, $g_{Rs}$, are defined as the gains that will be applied to the coefficient $c_s$ to obtain the complex frequency coefficients of the output coefficient tables, as well as two gains $g_B$ and $g_T$ corresponding to virtual speakers allowing a redistribution of the signals into "Bottom", i.e., with a negative elevation, and "Top", i.e., with a positive elevation, to the other speakers.

$$g_B = \max(\sin(-e), 0) \tag{55}$$

$$g_T = \max(\sin(e), 0) \tag{56}$$

If $a \in [0^\circ, 30^\circ]$, $$\begin{cases} g_C = \cos(e)pan1(a, 0^\circ, 30^\circ) \\ g_L = \cos(e)pan2(a, 0^\circ, 30^\circ) \\ g_R = g_{Ls} = g_{Rs} = 0 \end{cases} \tag{57}$$

If $a \in [30^\circ, 105^\circ]$, $$\begin{cases} g_L = \cos(e)pan1(a, 30^\circ, 105^\circ) \\ g_{Ls} = \cos(e)pan2(a, 30^\circ, 105^\circ) \\ g_{Rs} = g_C = g_R = 0 \end{cases} \tag{58}$$

if $a + k \times 360^\circ \in [105^\circ, 360^\circ - 105^\circ], k \in Z$,

-continued $$\begin{cases} g_{Ls} = \cos(e)pan1(a, 105^\circ, 360^\circ - 105^\circ) \\ g_{Rs} = \cos(e)pan2(a, 105^\circ, 360^\circ - 105^\circ) \\ g_L = g_C = g_R = 0 \end{cases} \quad (59)$$

If $a \in [-105^\circ, -30^\circ]$, $$\begin{cases} g_{Rs} = \cos(e)pan1(a, -105^\circ, -30^\circ) \\ g_R = \cos(e)pan2(a, -105^\circ, -30^\circ) \\ g_L = g_C = g_{Ls} = 0 \end{cases} \quad (60)$$

If $a \in [-30^\circ, 0^\circ]$, $$\begin{cases} g_L = \cos(e)pan1(a, -30^\circ, 0^\circ) \\ g_C = \cos(e)pan2(a, -30^\circ, 0^\circ) \\ g_R = g_{Ls} = g_{Rs} = 0 \end{cases} \quad (61)$$

where $$\begin{cases} pan1(a, a_1, a_2) = \cos\left(\frac{\pi}{2}\frac{a - a_1}{a2 - a1}\right) \\ pan2(a, a_1, a_2) = \sin\left(\frac{\pi}{2}\frac{a - a_1}{a2 - a1}\right) \end{cases} \quad (62)$$

then gains $g_B$ and $g_T$ are redistributed between the other coefficients:

$$\begin{cases} g_L = \sqrt{g_L^2 + \frac{1}{6}(g_T + g_R)^2} \\ g_C = \sqrt{g_C^2 + \frac{1}{6}(g_T + g_B)^2} \\ g_R = \sqrt{g_R^2 + \frac{1}{6}(g_T + g_B)^2} \\ g_{Ls} = \sqrt{g_{Ls} + \frac{1}{4}(g_T + g_B)^2} \\ g_{Rs} = \sqrt{g_{Rs} + \frac{1}{4}(g_T + g_B)^2} \end{cases} \quad (63)$$

Lastly, the frequency coefficients of the various channels are obtained by:

$$\begin{cases} c_L = g_L c_S \\ c_C = g_C c_S \\ c_R = g_R c_S \\ c_{Ls} = g_{Ls} c_S \\ c_{Rs} = g_{Rs} c_S \end{cases} \quad (64)$$

Transcoding into a L-C-R-Ls-Rc 5.0 multichannel audio format, to which a T zenith channel ("top" or "voice of God" channel) is added can also be done in the frequency domain. During the redistribution of the gains of the virtual channels, only the redistribution of the "bottom" gain $g_B$ is then done:

$$\begin{cases} g_L = \sqrt{g_L^2 + \frac{1}{6}g_B^2} \\ g_C = \sqrt{g_C^2 + \frac{1}{6}g_B^2} \\ g_R = \sqrt{g_R^2 + \frac{1}{6}g_B^2} \\ g_{Ls} = \sqrt{g_{Ls}^2 + \frac{1}{4}g_B^2} \\ g_{Rs} = \sqrt{g_{Rs}^2 + \frac{1}{4}g_B^2} \end{cases} \quad (65)$$

and the frequency coefficients of the various channels are obtained by:

$$\begin{cases} c_L = g_L c_S \\ c_C = g_C c_S \\ c_R = g_R c_S \\ c_{Ls} = g_{Ls} c_S \\ c_{Rs} = g_{Rs} c_S \\ c_T = g_T c_S \end{cases} \quad (66)$$

The six complex coefficients thus obtained for each frequency band are assembled to respectively generate frequency representations of six channels L, C, R, Ls, Rs and T, and the application of the frequency-to-time transform (inverse of that used for the time-to-frequency transform), any clipping, then the overlap of the successive time windows obtained makes it possible to obtain six channels in the temporal domain.

Furthermore, for a format having any spatial arrangement of the channels, it will advantageously be possible to apply a three-dimensional VBAP algorithm to obtain the desired channels, while guaranteeing, if needed, a good triangulation of the sphere by adding virtual channels that are redistributed toward the final channels.

A transcoding of a signal expressed in the spherical domain toward a binaural format may also be done. It may for example be based on the following elements:

- a database including, for a plurality of frequencies, for a plurality of directions in space, and for each ear, the expression and complex coefficients (magnitude and phase) of the Head-Related Transfer Function (HRTF) filters in the frequency domain;
- a projection of said database in the spherical domain to obtain, for a plurality of directions and for each ear, a complex coefficient for each frequency from among a plurality of frequencies;
- a spatial interpolation of said complex coefficients, for any frequency from among a plurality of frequencies, so as to obtain a plurality of complex spatial functions continuously defined on the unit sphere, for each frequency from among a plurality of frequencies. This interpolation can be done in a bilinear or spline manner, or via spherical harmonic functions.

One thus obtains a plurality of functions on the unit sphere, for any frequency, describing the frequency behavior of said HRTF database for any point of the spherical space. Since, for any frequency from a plurality of frequencies, it is established that said spherical signal is described by a direction of origin (azimuth, elevation) and a complex coefficient (magnitude, phase), said interpolation-projection next makes it possible to perform the binauralization operation of the spherical signal, as follows:

for each frequency and for each ear, given the direction of origin of said spherical signal, one establishes the value of said complex spatial function previously established by projection and interpolation, resulting in a HRTF complex coefficient;

for each frequency and for each ear, said HRTF complex coefficient is then multiplied by the complex coefficient corresponding to the spherical signal, resulting in a left ear frequency signal and a right ear frequency signal;

a frequency-to-time transform is then done, yielding a dual-channel binaural signal.

Furthermore, the spherical harmonic formats are often used as intermediate formats before decoding on speaker constellations or decoding by binauralization. The multichannel formats obtained via VBAP rendering are also subject to binauralization. Other types of transcoding can be obtained by using standard spatialization techniques such as pairwise panoramic with or without horizontal layers, SPCAP, VBIP or even WFS. It is lastly necessary to note the possibility of changing the orientation of the spherical field, by altering the direction vectors using simple geometric operations (rotations around an axis, etc.). By applying this capability, it is possible to perform an acoustic compensation of the rotation of the listener's head, if it is captured by a head-tracking device, just before applying a rendering technique. This method allows a perceptual gain in location precision of the sound sources in space; this is a known phenomenon in the field of psychoacoustics: small head movements allow the human auditory system to better locate sound sources.

By applying conversion techniques between the two domains that were previously described, the encoding of a spherical signal can be done as follows. The spherical signal is made up of temporally successive tables each corresponding to a representation over a temporal window of the signal, these windows overlapping. Each table is made up of pairs (complex frequency coefficient, coordinates on the sphere in azimuth and elevation), each pair corresponding to a frequency band. The original spherical signal is obtained from spatial analysis techniques like those described, which convert an FOA signal into a spherical signal. The encoding makes it possible to obtain temporally successive pairs of complex frequency coefficient tables, each table corresponding to a channel, for example left (L) and right (R).

Figure 11:
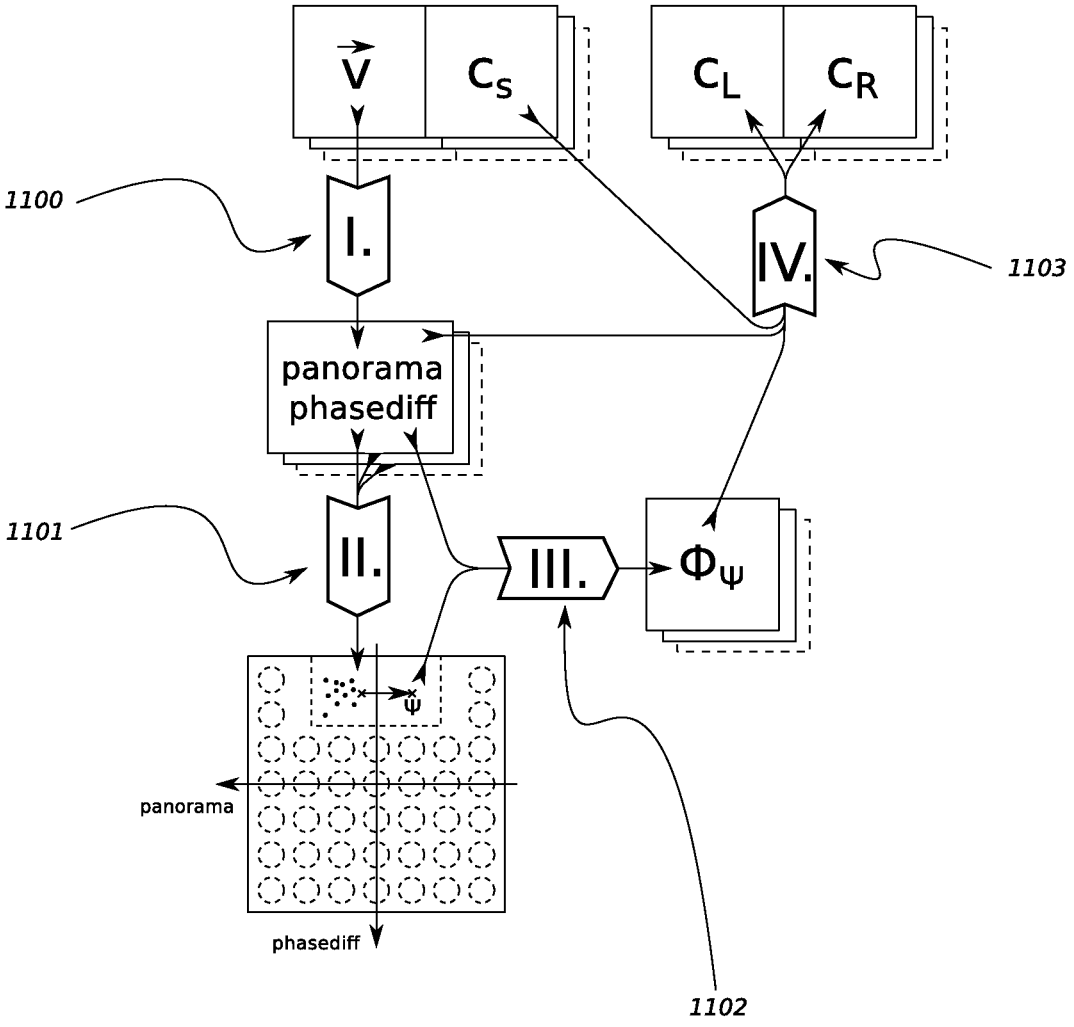
FIG. 11 shows the diagram of the encoding process, converting a signal from the spherical domain to the inter-channel domain.

FIG. 11 shows the diagram of the encoding process, converting from the spherical domain to the inter-channel domain. The sequence of the encoding technique for each temporal window successively processed is thus illustrated:

A first step (1100) consists of determining, for each element of the input table, the panorama and the phase difference corresponding to each spherical coordinate, as indicated in equations 43. Optionally, the widening of the azimuth from the interval [−30°, 30°] to the interval [−90°, 90° ] can be done according to the method previously indicated, before the determination of the panorama and the phase difference, this widening corresponding to the operation (1302) of FIG. 13.

A second step (1101) consists of determining the new position of the singularity in the inter-channel domain, by analyzing the panorama and phase difference coordinates determined in the first step.

A third step (1102) consists of determining the phase correspondence $\phi_\Psi$, (panorama, phasediff) for each complex coefficient of the input table.

A fourth step (1103) consists of building a table of pairs of complex coefficients $c_L$ and $c_R$, according to the complex frequency coefficients of the spherical domain $c_s$, the calculated panorama and phase difference values, and the phase difference function:

$$\begin{cases} |c_L| = |c_S|\sqrt{\frac{1}{2}(1+\text{panorama})} \\ \arg(c_L) = \arg(c_S) - \Phi_\Psi(\text{panorama}, \textit{phasediff}) - \frac{1}{2}\textit{phasediff} \\ |c_R| = |c_S|\sqrt{\frac{1}{2}(1-\text{panorama})} \\ \arg(c_R) = \arg(c_S) - \Phi_\Psi(\text{panorama}, \textit{phasediff}) + \frac{1}{2}\textit{phasediff} \end{cases} \tag{67}$$

An alternative technique for determining the magnitude of the complex frequency coefficients is presented in equation 5.

The representation in the form of temporally successive pairs of complex frequency coefficient tables is generally not kept as is; the application of the appropriate frequency-to-time inverse transform (the inverse of the direct transform used upstream), such as the frequency-to-time part of the short-term Fourier transform, makes it possible to obtain a pair of channels in the form of temporal samples.

Figure 12:
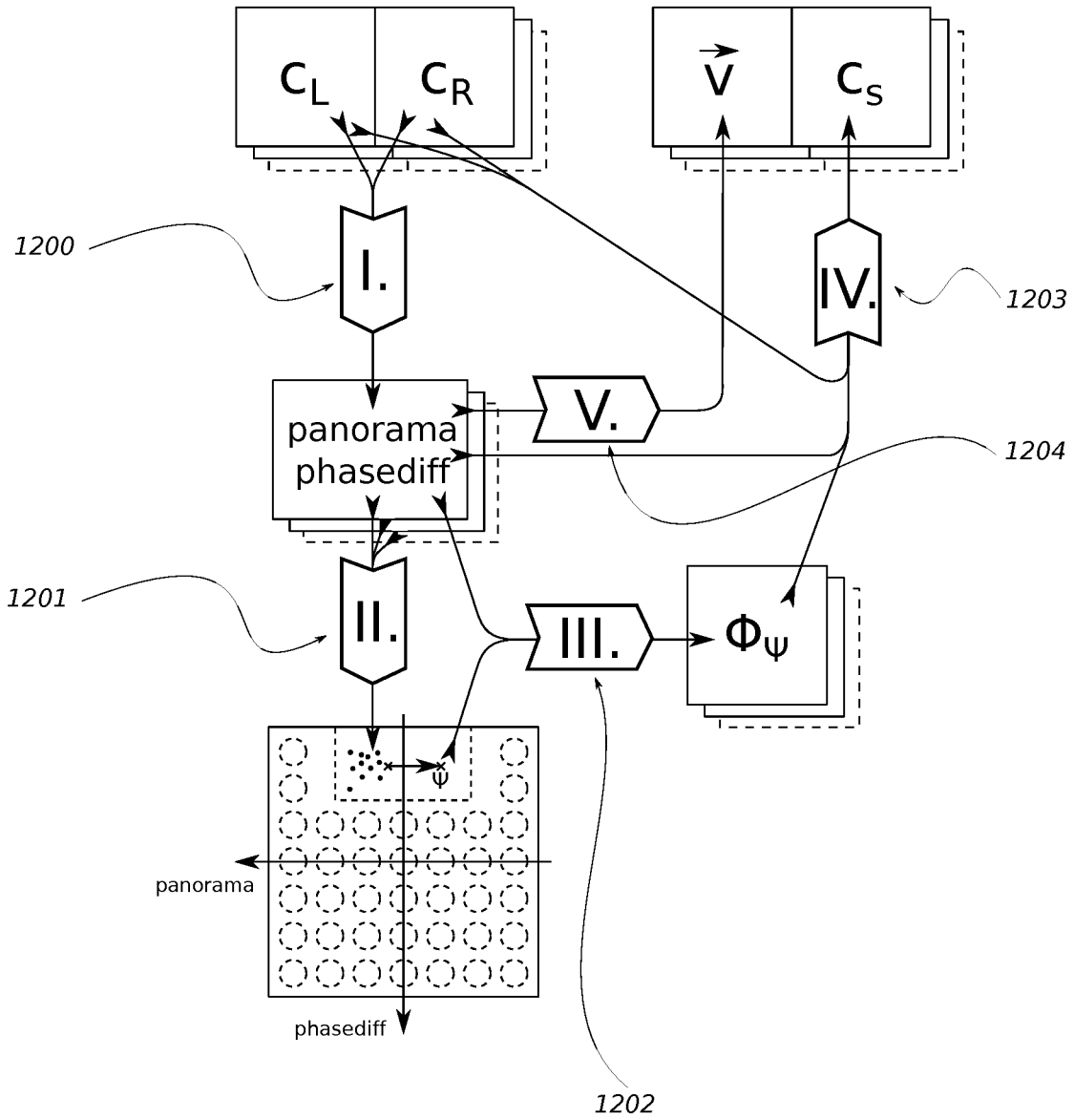
FIG. 12 shows the diagram of the decoding process, converting a signal from the inter-channel domain to the spherical domain.

Pursuant to the domain conversion techniques previously described, the decoding of a stereo signal encoded with the technique previously presented can be done as follows. The input signal being in the form of a pair of channels that are generally temporal, a transform such as the short-term Fourier transform is used to obtain temporally successive pairs of complex frequency coefficient tables, each coefficient of each table corresponding to a frequency band. In each pair of tables corresponding to a temporal window, the coefficients corresponding to the same frequency band are paired. The decoding makes it possible to obtain, for each temporal window, a spherical representation of the signal, in pair table form (complex frequency coefficient, coordinates on the sphere in azimuth and elevation). Here is the sequence of the decoding technique for each temporal window successively processed, illustrated in FIG. 12:

A first step (1200) consists of determining the panorama and the phase difference for each pair, as indicated in equations 2 or 4, and 6.

A second step (1201) consists of determining the new position of the singularity Ψ in the inter-channel domain, by analyzing the panorama and phase difference coordinates determined in the first step.

A third step (1202) consists of determining the phase correspondence $\phi_\Psi$ (panorama, phasediff) for each complex coefficient of the input table, from results of the first and second steps.

A fourth step (1203) consists of determining, from results of the first (1200) and third (1202) steps, the complex frequency coefficient $c_s$ in the spherical domain:

$$\begin{cases} |c_S| = \sqrt{|c_L|^2 + |c_R|^2} \\ \arg(c_S) = \phi_i + \Phi_\Psi(\text{panorama}, \textit{phasediff}) \end{cases} \tag{68}$$

where $\phi_i$ is the intermediate phase, for example obtained with: $\phi_i = \arg(c_L) + \frac{1}{2}$ phasediff.

A fifth step (1204) consists of determining, from results of the first step (1200), the azimuth and elevation coordinates as indicated in equations 41. Optionally, the narrowing of the azimuth from the interval [−90°, 90°] to the interval [−30°, 30° ] can be done, according to the method previously indicated, this step corresponding to the operation (1301) of FIG. 13.

A pair table (complex frequency coefficient, coordinates on the sphere in azimuth and elevation) is obtained, each pair corresponding to a frequency band. This spherical representation of the signal is generally not kept as is, but undergoes transcoding based on broadcasting needs: it is thus possible, as was seen above, to perform transcoding (or "rendering") to a given audio format, for example binaural, VBAP, planar or three-dimensional multi-channel, first-order Ambisonics (FOA) or higher-order Ambisonics (HOA), or any other known spatialization method as long as the latter makes it possible to use the spherical coordinates to steer the desired position of a sound source.

Large quantities of stereo content being encoded in surround form with a mastering technique, and the coordinates of the mastering points generally being positioned in the inter-channel domain in consistent positions, the decoding of such surround content works, with a few absolute positioning defects of the sources. Therefore, in general, the stereo content not provided to be played on a device other than a speaker system pair may advantageously be processed using the decoding method, resulting in a 2D or 3D upmix of the content, the term "upmix" corresponding to processing a signal to be able to broadcast it on devices with a number of speaker systems greater than the number of original channels, each speaker system receiving a signal that is specific to it, or its virtualized equivalent in the headset.

INDUSTRIAL APPLICATIONS OF THE INVENTION

The stereophonic signal resulting from the encoding of a three-dimensional audio field can be reproduced suitably without decoding on a standard stereophonic listening device, for example audio headset, sound bar or audio system. Said signal can also be processed by the mastered surround content multichannel decoding systems that are commercially available without audible artifacts appearing.

The decoder according to the invention is versatile: it makes it possible simultaneously to decode content specially encoded for it, to decode content pre-existing in the mastered surround format (for example, cinematographic sound content) in a relatively satisfactory manner, and to upmix stereo content. It thus immediately finds its utility, embedded via software or hardware (for example in the form of a chip) in any system dedicated to sound broadcasting: television, hi-fi audio system, living room or home cinema amplifier, audio system on board a vehicle, equipped with multichannel broadcasting system, or even any system broadcasting for listening in headphones, via binaural rendering, optionally with head-tracking, such as a computer, a mobile telephone, a digital-audio portable music player. A listening device with crosstalk cancellation also allows binaural listening without headphones from at least two speakers, and allows surround or 3D listening to sound content decoded by the invention and binaural rendering. The decoding algorithm described in the present invention makes it possible to rotate the sound space on the direction of origin vectors of the obtained spherical field, the direction of origin being that which would be perceived by a listener located at the center of said sphere; this capacity makes it possible to implement tracking of the listener's head (or head-tracking) in the processing chain as close as possible to its rendering, which is an important element to reduce the lag between the movements of the head and their compensation in the audible signal.

An audio headset itself may embed the described decoding system in one embodiment of the present invention, optionally by adding head-tracking and binaural rendering functions.

The prerequisite processing and content broadcasting infrastructure is already ready for the application of the present invention, for example the stereo audio connector technology, the stereophonic digital encoding such as MPEG-2 layer 3 or AAC, the FM or DAB stereo radio broadcasting techniques, or the wireless, cable or IP video stereophonic broadcasting standards.

The encoding in the format presented in this invention is done at the end of multichannel or 3D mastering (finalization), from a FOA field via a conversion to a spherical field like one of those presented in this document or from another technique. The encoding may also be done on each source added to the sound mixing, independently of one another, using spatialization or panoramic tools embedding the described method, which makes it possible to perform 3D mixing on digital audio workstations only supporting 2 channels. This encoded format may also be stored or archived on any medium only comprising two channels, or for size compression purposes.

The decoding algorithm makes it possible to obtain a spherical field, which may be altered, by deleting the spherical coordinates while only keeping the complex frequency coefficients, in order to obtain a mono downmix. This process may be implemented by software, or hardware to embed it in an electronic chip, for example embedded in monophonic FM listening devices.

Furthermore, the content of video games and virtual reality or augmented reality systems may be stored in stereo encoded form, then decoded to be spatialized again by transcoding, for example in FOA field form. The availability of direction of origin vectors also makes it possible to manipulate the sound field using geometric operations, for example allowing zooms, distortions following the sound environment such as by projecting the sphere of the directions on the inside of a room of a video game, then deformation by parallax of the direction of origin vectors. A video game or other virtual reality or augmented reality system having a surround or 3D audio format as internal sound format may also encode its content before broadcasting; as a result, if the final listening device of the user implements the decoding method disclosed in the present invention, it thus provides a three-dimensional spatialization, and if the device is an audio headset implementing head-tracking (tracking the orientation of the listener's head), the binaural customization and the head-tracking allow dynamic immersive listening.

The embodiments of the present invention can be carried out in the form of one or more computer programs, said computer programs operating on at least one computer or on at least one processing circuit of the embedded signal, locally, remotely or distributed (for example in the context of an infrastructure in the "cloud").

The invention claimed is:

1. A method for converting a first-order Ambisonics signal into a spherical field made up of a plurality of monochromatic progressive plane waves, by a computer programmed to perform the following operations when encoding the spherical field to obtain an encoded stereophonic signal for any frequency from among a plurality of frequencies, the method comprising:

separating said Ambisonics signal into three components comprising:

a first complex vectorial component (A), corresponding to a mean acoustic intensity vector of said Ambisonics signal, a second complex vectorial component (B), a complex coefficient of which is equal to subtraction of the pressure wave generated by the component A from a pressure component of said Ambisonics signal, and a direction of which is modified as a function of a random process, a third complex vectorial component (C) corresponding to a subtraction of a pressure gradient generated by the component A from a pressure gradient of said Ambisonics signal, phases of which are modified as a function of a random process, and each of three axial components of which assumes, as direction, a vector derived from a random process;

grouping said first, second and third vectorial components A, B and C into a total vector and a total complex coefficient describing said spherical field, wherein:

the total complex coefficient is equal to the sum of the complex coefficients corresponding to said first, second and third vectorial components, and the total vector is equal to the sum of the directions of said three components, weighted by the magnitude of the complex coefficients corresponding to said three components; and outputting an encoded stereophonic signal based on the total complex coefficient and the total vector.

2. The method for converting a first-order Ambisonics signal to a spherical field according to claim 1, wherein said second vectorial component B is assigned an arbitrary and predefined direction of origin with negative elevations.

3. A method for converting a first-order Ambisonics signal into a spherical field made up of a plurality of monochromatic progressive plane waves, comprising, for any frequency from among a plurality of frequencies:

separating said Ambisonics signal into:

a first complex vectorial component (A), determined by a complex coefficient and a direction, said first complex vectorial component being obtained by:

(a1) determining a divergence value, calculated as the ratio between a mean acoustic intensity of said Ambisonics signal and the square of the magnitude of a pressure component of said Ambisonics signal, said ratio being saturated at a maximum value of 1, (a2) determining a complex coefficient corresponding to the pressure component of said Ambisonics signal, (a3) determining the direction of said first vectorial component (A), calculated by a weight, as a function of said divergence value, between the direction of a mean acoustic intensity vector and the direction of a vector generated by a random process; and a second complex vectorial component (C), determined by a complex coefficient and a direction, said second complex vectorial component being obtained by:

(c1) determining three axial complex components of the pressure gradient of said Ambisonics signal, (c2) determining three axial complex components of the pressure gradient that would be generated by a monochromatic progressive plane wave, a complex coefficient of the monochromatic progressive plane wave would be that of the pressure of the Ambisonic signal multiplied by the divergence value and the direction of which would be that of the mean acoustic intensity vector, (c3) subtracting the result of said (c2) from the result of said (c1), and (c4) changing the phases and direction vectors of the three axial components of the result of said (c3), as a function of a random process, to obtain the complex coefficients and the directions of said second vectorial component (C);

grouping said first and second vectorial components A and C into a total vector and a total complex coefficient describing said spherical field, wherein:

the total complex coefficient is equal to the sum of the complex coefficients corresponding to said first and second vectorial components, and the total vector is equal to the sum of the directions of said first and second vectorial components, weighted by the magnitude of the complex coefficients corresponding to said two components; and outputting an encoded stereophonic signal based on the total complex coefficient and the total vector.

4. A method for converting said first-order Ambisonics signal into a spherical field according to claim 1, further comprising encoding said spherical field to obtain the encoded stereophonic signal by determining panorama and phase difference values from spherical spatial coordinates describing said spherical field, for any frequency from among a plurality of frequencies, determining the position of the singularity $\Psi$ in the inter-channel domain, done by analyzing the panorama and phase difference values and moving said singularity from a preceding position of said singularity such that said singularity is not positioned on a useful signal, determining a phase correspondence $\Phi_{\Psi}$(panorama,phasediff) corresponding to each pair of complex coefficients derived from said spherical field, and determining a table of complex coefficient pairs $c_L$ and $c_R$, for any frequency from a plurality of frequencies, from complex coefficients derived from the spherical field $c_s$, the phase correspondence, and the phase difference values, said complex coefficients CL and CR being combined to obtain said encoded stereophonic signal.

* * * * *